US006986708B2

(12) United States Patent
Demster

(10) Patent No.: US 6,986,708 B2
(45) Date of Patent: Jan. 17, 2006

(54) METHOD AND APPARATUS FOR DELIVERING CONDITIONED AIR USING DUAL PLENUMS

(75) Inventor: Stanley J. Demster, Lenexa, KS (US)

(73) Assignee: AirFixture L.L.C., Kansas City, KS (US)

( * ) Notice: Subject to any disclaimer, the term of this patent is extended or adjusted under 35 U.S.C. 154(b) by 0 days.

(21) Appl. No.: 10/423,648

(22) Filed: Apr. 25, 2003

(65) Prior Publication Data

US 2003/0213853 A1 Nov. 20, 2003

Related U.S. Application Data

(63) Continuation-in-part of application No. 10/150,266, filed on May 17, 2002, now Pat. No. 6,945,866.

(51) Int. Cl.
*F24F 7/10* (2006.01)
*F24F 13/06* (2006.01)

(52) U.S. Cl. ..... 454/248; 454/292; 454/354

(58) Field of Classification Search ..... 454/237, 454/245, 246, 247, 248, 292, 354; 236/49.3
See application file for complete search history.

(56) References Cited

U.S. PATENT DOCUMENTS

| | | | | |
|---|---|---|---|---|
| 2,489,515 | A | | 11/1949 | Blake et al. |
| 3,010,378 | A | | 11/1961 | Geocaris |
| 3,103,156 | A | | 9/1963 | Quin |
| 3,117,509 | A | | 1/1964 | Archer et al. |
| 3,353,472 | A | | 11/1967 | Lee et al. |
| 3,720,258 | A | | 3/1973 | Chandler |
| 3,949,808 | A | | 4/1976 | Gilles |
| 4,077,310 | A | | 3/1978 | McCabe, Jr. et al. |
| 4,222,316 | A | | 9/1980 | Adam |
| 4,258,615 | A | | 3/1981 | Vivian |
| 4,407,445 | A | | 10/1983 | Vivian |
| 4,562,883 | A | | 1/1986 | Janeke |
| 4,824,012 | A | | 4/1989 | Tate |
| 4,838,483 | A | | 6/1989 | Nurczyk et al. |
| 4,841,733 | A | * | 6/1989 | Dussault et al. ..... 62/93 |
| 4,919,327 | A | | 4/1990 | Elluin et al. |
| 4,928,750 | A | | 5/1990 | Nurczyk |
| 4,931,948 | A | | 6/1990 | Parker et al. |
| 5,033,361 | A | | 7/1991 | Moszkowski |
| 5,103,896 | A | | 4/1992 | Saga |
| 5,117,900 | A | | 6/1992 | Cox |
| 5,275,333 | A | | 1/1994 | Tamblyn |
| 5,467,919 | A | | 11/1995 | Tamblyn |
| 5,495,724 | A | | 3/1996 | Koster |

(Continued)

*Primary Examiner*—William E. Tapolcai
(74) *Attorney, Agent, or Firm*—Shook, Hardy & Bacon L.L.P.

(57) ABSTRACT

Multiple methods of supplying conditioned air to a room and components therefor are provided. A dual plenum system has a supply plenum for delivering supply air to the room and a return plenum for returning room air to an air handling unit. Conduits are provided to permit passage of the return air through the supply plenum without breaching the integrity of the supply plenum. Modular units permit a user to customize the supply and return apparatuses. A terminal unit having a controllable damper blade can be applied to a diffuser to permit the unit to be convertible between a constant volume unit and a variable volume unit. A thermostat generates signals that open and close the damper blade at determined intervals.

27 Claims, 24 Drawing Sheets

U.S. PATENT DOCUMENTS

| | | | |
|---|---|---|---|
| 5,725,148 | A | 3/1998 | Hartman |
| 5,743,101 | A | 4/1998 | Shida et al. |
| 5,810,245 | A | 9/1998 | Heitman et al. |
| 6,019,677 | A | 2/2000 | Demster |
| 6,099,406 | A | 8/2000 | Demster |
| 6,185,943 | B1 | 2/2001 | Kopko |
| 6,260,375 | B1 | 7/2001 | Kuo |
| 6,405,543 | B2 | 6/2002 | Kopko |
| 2001/0048030 | A1 | 12/2001 | Sharood et al. |
| 2002/0017571 | A1 | 2/2002 | Riley et al. |

* cited by examiner

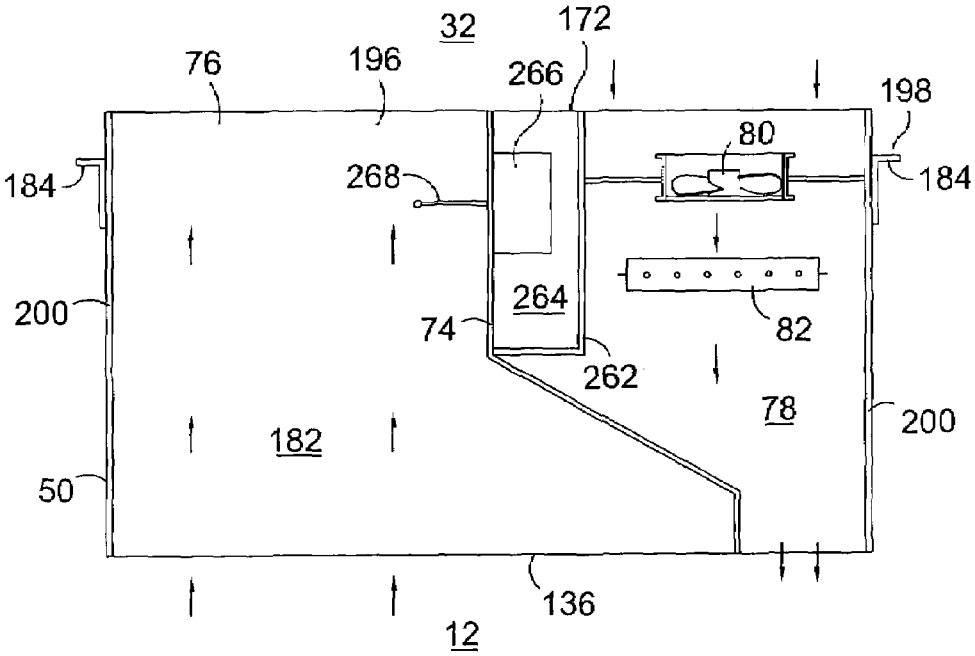
FIG. 28.
FIG. 29.
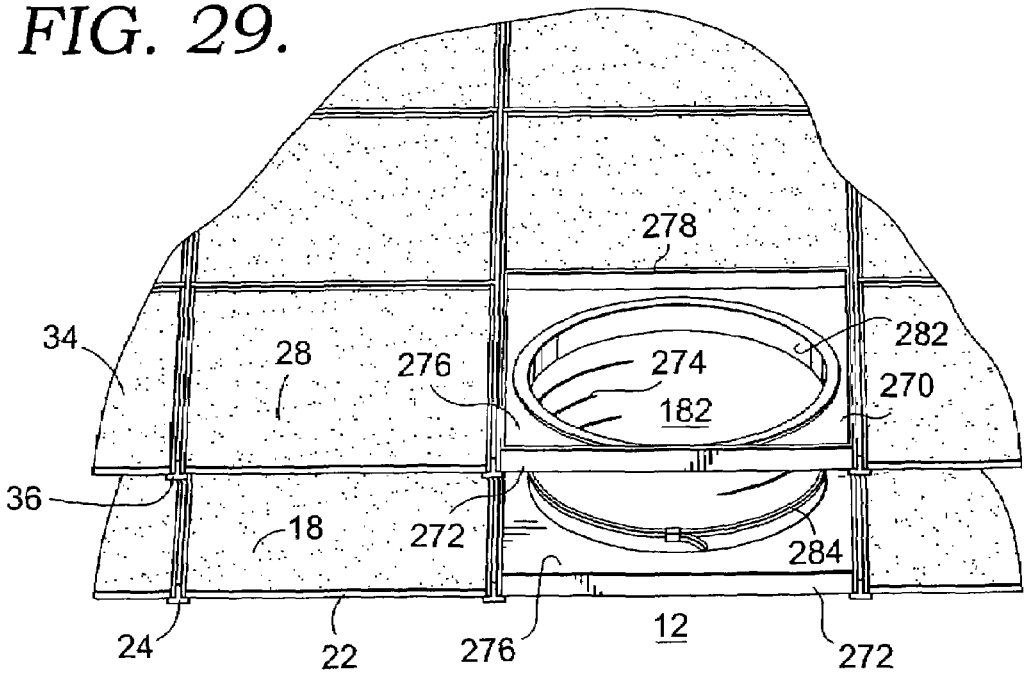

METHOD AND APPARATUS FOR DELIVERING CONDITIONED AIR USING DUAL PLENUMS

CROSS-REFERENCE TO RELATED APPLICATIONS

This application is a continuation-in-part of pending application Ser. No. 10/150,266 filed by Stanley J. Demster on May 17, 2002 now U.S. Pat. No. 6,945,866 and entitled "Method and Apparatus for Delivering Conditioned Air Using Pulse Modulation".

STATEMENT REGARDING FEDERALLY SPONSORED RESEARCH OR DEVELOPMENT

Not applicable.

FIELD OF THE INVENTION

This invention relates in general to systems for the delivery of conditioned air to occupied spaces in buildings and deals more particularly with a method and apparatus for distributing air in an economical and efficient manner, as well as to improvements in various components and systems that are useful in equipment for delivering conditioned air.

BACKGROUND OF THE INVENTION

Office buildings and various types of commercial buildings are typically heated and cooled using rooftop, floor by floor, or central station air handling units. Supply ducts are installed in the interstitial space that is located above the ceiling and below the structural roof. The supply ductwork extends from the air handling unit to a number of air diffusers that are often mounted on the ceiling. Suspended tile ceilings are common in this type of building, and the diffusers are usually integrated into the ceiling tile system, along with lights, sprinklers, smoke detectors, electrical outlets and sometimes other devices such as cameras, motion detectors, speakers and various other fixtures. The return air system may include a number of return air grills that are built into the ceiling tiles and connected with return air ductwork that directs return air back to the air handling unit.

Although systems of this type have long been in widespread use, they are not wholly free of problems. The need to install extensive ductwork above the ceiling creates a large cost factor and adds significantly to the labor costs that are involved in constructing and finishing the space. The ductwork also occupies a large amount of space and reduces the space that is available for other components and equipment that must be installed in the interstitial space. The delivery of conditioned air is often less than ideal from an efficiency and comfort standpoint. In the latter respect, the air return system can be significantly mismatched relative to the supply system so that the rooms in the space can be uncomfortably warm at times and uncomfortably cool at other times. The need to provide separate fixtures for the supply and return systems also increases the cost of fabrication, shipping, handling, storage and installation of the fixtures. The need for two different fixtures for the supply and return systems also adds to the clutter on the ceiling and detracts from the ceiling aesthetics.

Other problems with conventional air delivery systems can arise from undue humidity in the supply ducts. This can lead to fouling of the ductwork with mildew, mold, fungi, and various micro-organisms that can create unhealthy conditions in the occupied space.

Although a variety of styles, from large rectangular units to rounded knobs, are available currently, most thermostats are visually unappealing. Conventional thermostats are normally simple rectangular boxes or dome structures that are mounted to protrude from the wall and are designed as stand alone products. In fact, it appears that thermostat manufacturers have not placed any great emphasis on whether their devices could match the decoration of the room where the device was located. In fact, the exterior color and design of current devices appear arbitrary and directed to the device as a stand-alone product.

Even though attempts have been made to enhance the aesthetics of thermostats in recent years, their appearance has not been integrated effectively into the overall decor of the room. The color and design of the thermostat have not matched other common wall mounted devices such as light switches, electrical receptacles, telephone and cable television outlets, communications devices such as intercoms, and other wall fixtures such as occupancy sensors and the like. As a result, thermostats often detract appreciably from the aesthetic appeal of the rooms in which they are installed.

Recently, state and federal laws have addressed the mounting height and accessibility of thermostats. These requirements make the aesthetic functions and appearance of thermostats more important because mounting height requirements often place the thermostat directly adjacent to the light switch and other similar electrical devices. Currently, most thermostats are intended for surface mounting, either directly or using a sub-base that contains wiring termination points. While some thermostats include adaptors that allow the thermostats to be mounted on a standard electrical junction box, these configurations do not produce an integrated appearance with the other devices. It would be an aesthetic improvement if the thermostat could match these electrical devices in terms of size, color, shape and mounting method.

Thermostats have also suffered from relatively large dead bands that can result in the actual room temperature fluctuating 5° or more from the temperature setting. The need for anticipation circuits has added to the cost and complexity of the thermostat, as well as to problems with reliability.

In accordance with prevailing industry practices, many buildings are separated into several different air delivery zones that are each equipped with an individual air handling unit and separate ductwork. For example, a building may be divided into four separate quadrants that each has a peak requirement for a 25 ton air handling unit. In such a case, four 25 ton units are installed, each dedicated to its own zone and each connected with its own separate system of supply and return ducts. Each of the zones is subjected to its peak loading at a different time of day because of the movement of the sun and change of the sun angle throughout the day. Consequently, the overall simultaneous peak loading for the building as a whole may be 80 tons. Nevertheless, each air handling unit must be large enough to handle the maximum capacity for its own zone, so four 25 ton units are required even though 80 tons is the peak overall building load. The 20 tons of excess capacity adds markedly to the equipment expense, the installation and maintenance costs, and the energy that is used. The need for unduly large air handling units also detracts from the aesthetics of the building and increases the roof profile due to the need to install relatively large air handling units there.

BRIEF SUMMARY OF THE INVENTION

The present invention is directed to a system for delivering conditioned air in an improved manner and to various aspects of conditioned air distribution that enhance the efficiency and economics of its delivery and the comfort of occupants of the space that receives the conditioned air.

It is an object of the invention to provide a method and apparatus for delivering conditioned air that eliminates the need for extensive ductwork.

Another object of the invention is to provide, in a system for delivering conditioned air, a combination supply/return fitting that is specially constructed to assure a proper match between the supply air and the return air and to assure thorough mixing of the supply air without short circuiting problems. The combination supply/return fixture is particularly well suited for use in a dual plenum system and eliminates the problems that are associated with the need to supply separate fixtures for the air supply and air return systems.

A further object of the invention is to provide, in an air delivery system, a bypass path that accommodates a flow of bypass air from the return air pathway to the supply pathway in order to avoid excessive humidity in the supply path and also to make up for air that is lost in the supply system due to leakage.

Still another object of the invention is to provide an improved thermostat having enhanced aesthetic characteristics that can be matched to the decor of the room in which it is installed while functioning effectively to assure comfortable temperature conditions in the room.

Yet another object of the invention is to provide an improved temperature sensing and control device that has an appearance, packaging and is mounted comparable to a typical light switch device.

An additional object of the invention is to provide a conditioned air delivery system that minimizes the capacity requirements for air handling units in situations where multiple air handling units are installed in accordance with prevailing practices.

A still further object of the invention is to provide a method and apparatus for delivering conditioned air wherein the distribution and circulation of the supply air are enhanced while avoiding short circuiting of the supply air to the return system without mixing in the room.

Yet another object of the invention is to provide a method and apparatus for delivering conditioned air wherein cool air and heated air can be delivered alternatively in a manner to create comfortable conditions in the room to which the air is supplied.

Among the other objects of the invention are to provide an air delivery system that is economical to construct and install and energy efficient in operation, to provide an air delivery system that readily accommodates various ceiling mounted devices without unduly cluttering the ceiling or detracting significantly from its aesthetics, to provide an air delivery system that readily accommodates devices such as electrical wiring, sprinkler pipes and the like without undue obstruction or installation difficulties, and to provide a method and apparatus for delivering conditioned air at low pressures and low pressure differentials.

In accordance with one aspect of the invention, an air delivery system for applying conditioned air to a room makes use of a partition which separates the interstitial space above the ceiling of the room into separate supply and return plenums. The two plenums are preferably sealed from one another and from the room below. The ceiling may be a suspended ceiling, and the partition may be another suspended structure spaced above the suspended ceiling. By using the interstitial space in this manner to provide separate plenums, the need for extensive ductwork is avoided, along with the costs and problems associated with such ductwork.

The conditioned air may be directed into the room from the supply plenum through one or more ceiling air diffusers. The return air system may include a decorative return grill on the ceiling and a short return conduit that extends from the grill to the return plenum to provide a sealed pathway for directing return air out of the room to the air handling equipment. Preferably, the air diffuser that discharges the supply air into the room is adjacent to the return grill and may be constructed as part of a combination supply/return fixture. The diffuser slot is arranged to throw the supply air generally along the ceiling away from the return grill. In this manner, the supply air is circulated efficiently throughout the room and is mixed well without the potential for short circuiting directly back to the return system.

While the supply/return fixture can have only one diffuser, it is preferable for the supply/return fixture to include a pair of diffusers located on opposite sides of the return grill and constructed to direct the supply air in opposite directions away from the return grill. By constructing the supply and return fittings as single modular structures, the fittings can be installed in place of standard ceiling tiles. Significantly, the diffusers and the return conduit can be sized at the factory to assure that the return air is automatically matched properly to the supply air. This not only assures balancing of supply and return air to a room, but also provides a method of assuring the correct ratio of return to supply resistance necessary to maintain positive pressure relative to outdoor ambient for both the return and supply plenums. This arrangement assures that the return plenum can be kept at a positive differential static pressure to the outside ambient pressure, thereby reducing moisture infiltration, which in turn limits the growth of mold and other potentially harmful biological elements in the system.

By constructing the supply and return fittings as single modular structures, the supply and return terminals are also automatically located optimally relative to one another because they are constructed as parts of a single modular fitting. The modular fitting can be used either in a constant volume system or in a variable volume system in which the diffusers are equipped with control devices for varying the air discharge under the control of a thermostat. The modular fittings are also beneficial in that they can provide support and concealment for ceiling mounted devices such as smoke detectors, cameras, motion detectors and other equipment.

The dual plenum construction lends itself well to the inclusion of various optional features that enhance the delivery of air under differing conditions. For example, a bypass path between the return plenum and the supply plenum can be provided. Air in the return plenum can be applied directly to the supply plenum in the desired amounts by operating a fan installed in the bypass system. This serves to reduce the relative humidity in the supply plenum and also to make up for air leakage. The humidity reduction can inhibit the formation of mold, mildew and other humidity related problems in the supply air. Another option is to direct the return air from the return air plenum to the air diffusers through a heating system when temperature conditions call for heating rather than cooling.

In another aspect of the invention, an improved thermostat is constructed in a manner allowing it to be matched in color and appearance with light switches, electrical outlets and other items commonly mounted on walls. As a result, the thermostat can add aesthetically to the decor of the room instead of the more typical current situation where the thermostat is an unsightly wall mounted box or dome. At the same time, the thermostat of the present invention incorporates functional improvements such as the absence of a significant dead band and the elimination of the need for anticipation circuits and other complexities that are characteristic of existing thermostats.

Other and further objects of the invention, together with the features of novelty appurtenant thereto, will appear in the course of the following description.

BRIEF DESCRIPTION OF THE SEVERAL VIEWS OF THE DRAWING

In the accompanying drawings which form a part of the specification and are to be read in conjunction therewith and in which like reference numerals are used to indicate like parts in the various views:

FIG. 28 is a fragmentary sectional view of the modified combination supply/return fixture taken generally along line 28—28 of FIG. 27 in the direction of the arrows;

FIG. 29 is a fragmentary top perspective view of an alternate embodiment of a return conduit;

FIG. 36 is an elevational view of the junction box of FIG. 35 with the wall finished and the face plate on;

DETAILED DESCRIPTION OF THE INVENTION

Figure 1:
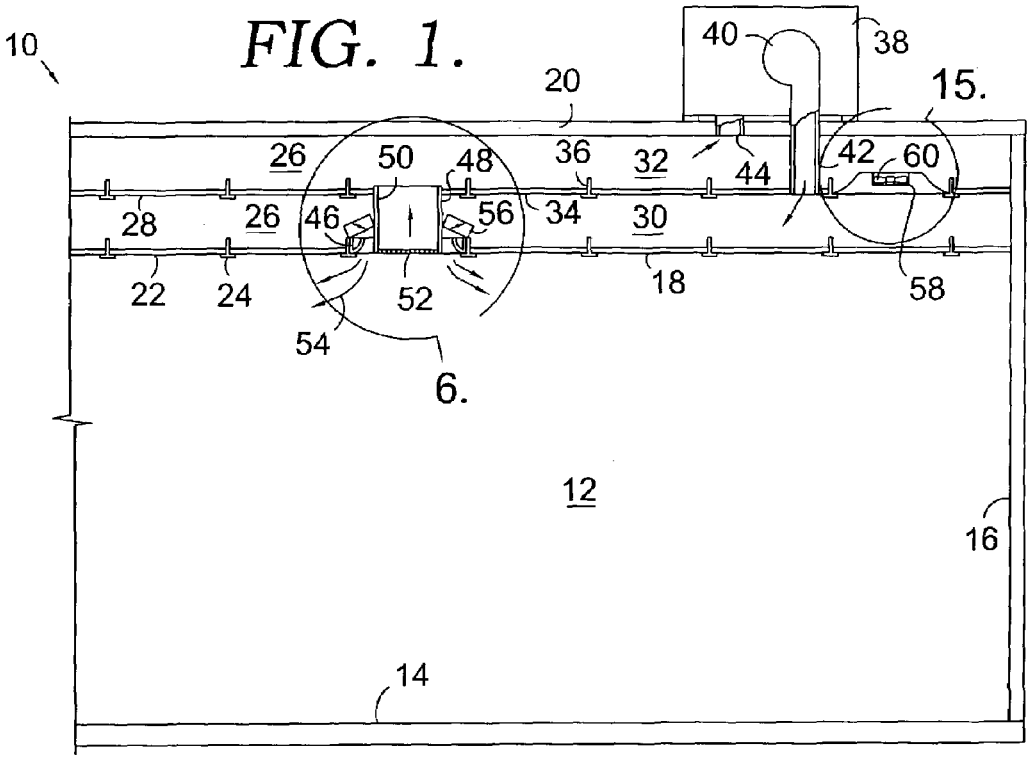
FIG. 1 is a fragmentary sectional view diagrammatically illustrating a room equipped with a conditioned air delivery system constructed in accordance with one embodiment of the present invention.

Referring now to the drawings in more detail and initially to FIG. 1, the present invention is directed to the delivery of conditioned air in a building 10 which may have a number of separate rooms 12 formed within it. Each of the rooms 12 may have an underlying floor 14 and walls 16. A ceiling which is generally identified by numeral 18 overlies the room and may be suspended from an overlying structure such as the roof 20 of the building. It should be noted that the roof 20 need not be the top of the building, but could simply be the structural ceiling of the room 12, such as a concrete slab that separates two floors of a building. The ceiling 18 may include a plurality of horizontal tiles 22 supported on a grid work of suspended T-bars 24. The bars 24 may be suspended from the roof 20 or another structure in a conventional fashion. An interstitial space 26 is presented above the ceiling 22 and below the roof 20. The T-bars 24 and tiles 22 may be constructed conventionally for the most part and installed in the building 10 in the manner of conventional suspended ceilings. However, as will be explained more fully, the tiles 22 are preferably sealed to the T-bars 24 in an airtight manner in order to provide an airtight seal between the interstitial space 26 and the room 12.

In accordance with the embodiment of the invention shown in FIG. 1, the interstitial space 26 is provided with a horizontal partition which is generally identified by numeral 28 and which divides the space 26 into a supply plenum 30 and a return plenum 32. The supply plenum 30 is located between the ceiling 18 and the partition 28. The return plenum 32 is located between the roof 20 and the partition 28. The supply plenum 30 is located immediately below and adjacent to the return plenum 32. Together, the supply and return plenums 30 and 32 occupy substantially the entirety of the interstitial space 26.

The partition 28 may be a suspended structure similar to the ceiling 18 and may include a plurality of individual tiles 34 mounted on a grid work of T-bars or, preferably, structural crosses 36. The crosses 36 may be suspended from the overlying roof 20 or supported in any other suitable way. The tiles 34 are preferably sealed to the crosses 36 in order to seal the supply plenum 30 from the return plenum 32. The tiles 22 and 34 may be conventional 24" by 24" square tiles of the type commonly used in suspended ceilings. Other types of tiles and other types of constructions for the ceiling 18 and partition 28 are also possible.

One or more air handling units such as the air handling unit 38 may be provided and may be roof mounted units as shown in FIG. 1. Each unit 38 is equipped with a fan or blower 40 having its discharge side connected with a discharge conduit 42 that extends downwardly to the supply plenum 30. The discharge conduit 42 extends through and is sealed from the return plenum 32. A suitable seal (not shown) is provided where the discharge conduit 42 penetrates the partition 28. A return conduit 44 extends from the return plenum 32 to the air handling unit 40 and supplies return air to the intake side of the blower 40.

Conditioned air which is supplied by the air handling unit 38 is delivered by the blower and discharge conduit 42 to the supply plenum 30 and is discharged from the supply plenum into the room through ceiling mounted air registers that may take the form of one or more air diffusers 46. The diffusers 46 may be formed as part of a combination supply/return fixture which is generally identified by numeral 48 and which may include a vertical air return conduit 50 as well as one or more of the diffusers 46. The return conduit 50 is covered at its lower end by a decorative grill 52 mounted on the ceiling. The fixture 48 may have a size to be installed in place of one of the ceiling tiles 22. As will be explained more fully, the return conduit 50 is provided with a seal at the location where it penetrates the partition 28. The return conduit 50 extends from the grill 52 to the return plenum 32 in order to provide a pathway for return air flowing from the room 12 to the return plenum 32.

The fixture 48 may be equipped with a pair of air diffusers 46 located on opposite sides of the return conduit 50 and arranged to direct the conditioned air from the supply conduit 30 generally along the ceiling 18 in opposite directions away from the return conduit 50, as indicated by the directional arrows 54 in FIG. 1. Each of the diffusers 46 may be equipped with a terminal unit 56 that may be a damper operated device of the type disclosed in pending application Ser. No. 10/150,266, filed on May 17, 2002 in the name of Stanley Demster and entitled "Method and Apparatus for Delivering Conditioned Air Using Pulse Modulation", which application is incorporated herein by reference. The dampers in the terminal units 56 are controlled by a thermostat as more particularly described in the aforementioned pending application or by one of the thermostats set forth below.

A bypass path 58 from the return plenum 32 to the supply plenum 30 may be provided so that bypass air can be delivered directly through the path 58 from the return plenum to the supply plenum. A conventional fan 60 may be mounted in the bypass path 58 in order to provide selected amounts of bypass air. The fan 60 may be a constant speed device or may be operated at varying rates of speed in order to vary the amount of bypass air delivered to the supply plenum 30.

In operation, the air delivery system of FIG. 1 provides air from the blower 40 through the discharge conduit 42 to the supply plenum 30 in a manner to normally maintain the supply plenum 30 with conditioned air during operation at a pressure from 0.0 to 0.1 inches water gauge ("wg") when compared to the pressure in the room 12, and preferably approximately 0.05 inches wg. It should be noted that the pressures being discussed herein are static differential water gauge pressures. As such, the outside pressure is the reference pressure and is therefore 0.0 inches wg. The pressure in the room 12 is from 0.001 to 0.03 inches wg, meaning it is positive pressure when compared to the outside reference pressure. This is desirable as a negative pressure would cause the building to try to draw air into the building, thereby creating drafts. Relative to the outside reference pressure, the supply plenum 30 would therefore preferably be at 0.08 inches wg 0.05 inches wg supply plenum 30 to room 12 differential+0.03 inches wg room 12 to outside differential).

Under suitable thermostat control, the conditioned air is discharged into the room 12 through the air diffusers 46 in a direction away from the return grill 52. The conditioned air that enters the room 12 through the air diffusers 46 flows generally along the ceiling 18 and then disperses down the walls 16 and along the floor 14 such that it mixes well with the air in the room before reaching the vicinity of the return grill 52. The return plenum 32 is connected with the intake side of the blower 40 and is preferably maintained at a pressure of approximately −0.02 inches wg when compared to the pressure of the room 12 (the return plenum is therefore at approximately 0.01 inches wg differential static pressure relative to the outside reference pressure) to thereby draw return air up into the return plenum 32. Thus, a pressure differential of approximately 0.07 inches wg between the supply plenum 30 and the return plenum 32 is preferably provided. It is preferred that the pressure in the supply plenum 30 be maintained at 0.10 inches wg or less, and approximately 0.05 inches wg is preferred. The return air is drawn through the grill 52 and the return conduit 50 into the return plenum 32 and is then returned to the air handling unit 38 through the return conduit 44.

By constructing the diffusers 46 and the return conduit 50 as part of a single combination fixture 48, the supply system and return system can be properly sized and matched for optimal performance. Also, the return conduit 50 can be properly located relative to the diffusers 46 so that the diffused air is directed away from the return conduit 50 to avoid significant short circuiting of air, thus achieving good mixing of the conditioned air in the room 12.

The bypass fan 60 can be activated if desired to apply selected amounts of air directly from the return plenum 32 to the supply plenum 30. This decreases the relative humidity of the conditioned air in the supply plenum 30 and thus avoids humidity related problems such as the formation of mold, mildew, fungi and various types of microorganisms that thrive under humid conditions. In addition, the bypass air serves to make up air that may be lost from the supply plenum 30 due to leakage.

Figure 2:
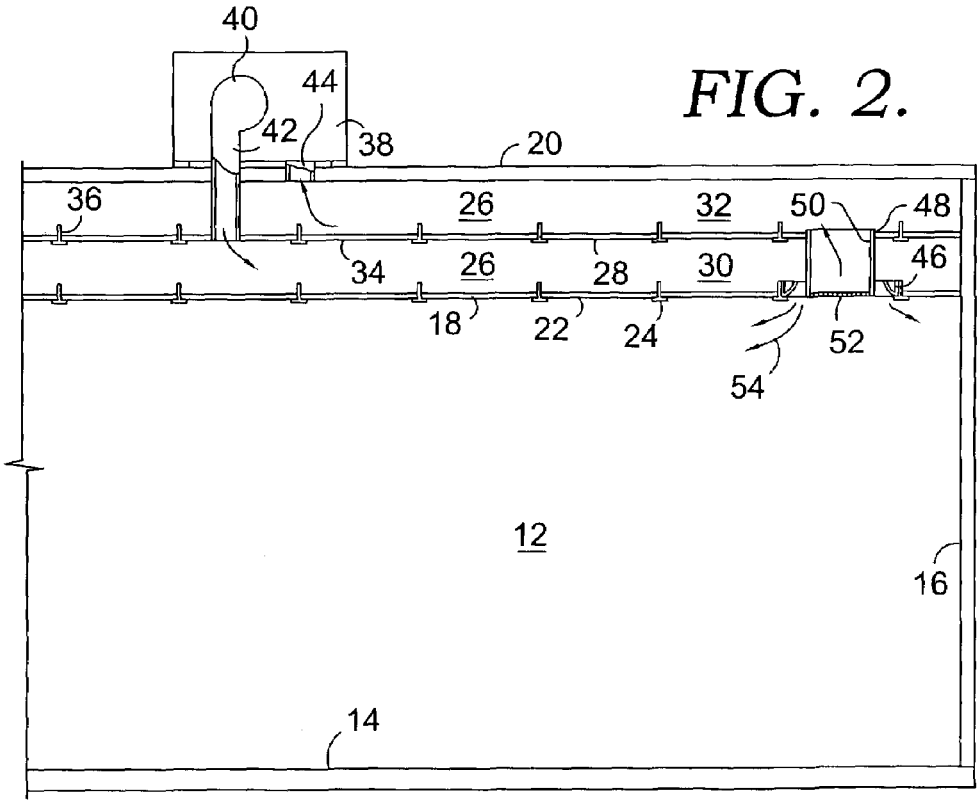
FIG. 2 is a fragmentary elevational view similar to FIG. 1 diagrammatically illustrating an air delivery system constructed according to another embodiment of the invention.

FIG. 2 depicts another embodiment of the invention which for the most part is constructed in a manner similar to the embodiment shown in FIG. 1. The principal difference is that the system shown in FIG. 2 is a constant volume system that lacks a volume control such as provided by the terminal units 56 in the system of FIG. 1. In the FIG. 2 system, the conditioned air flows through the air diffusers 46 at a constant rate. The system of FIG. 2 can be provided with a bypass path and bypass fan such as the bypass 58 and fan 60 shown in FIG. 1.

Figure 3:
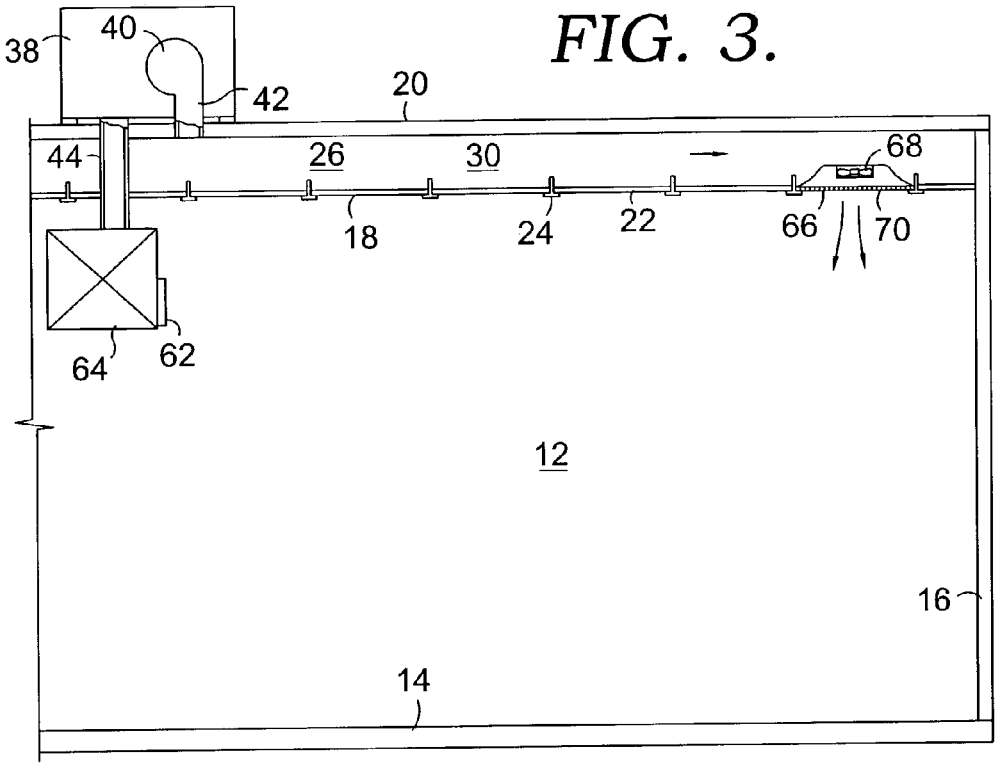
FIG. 3 is a fragmentary elevational view similar to FIGS. 1 and 2 diagrammatically illustrating an air delivery system constructed according to another embodiment of the invention.
Figure 15:
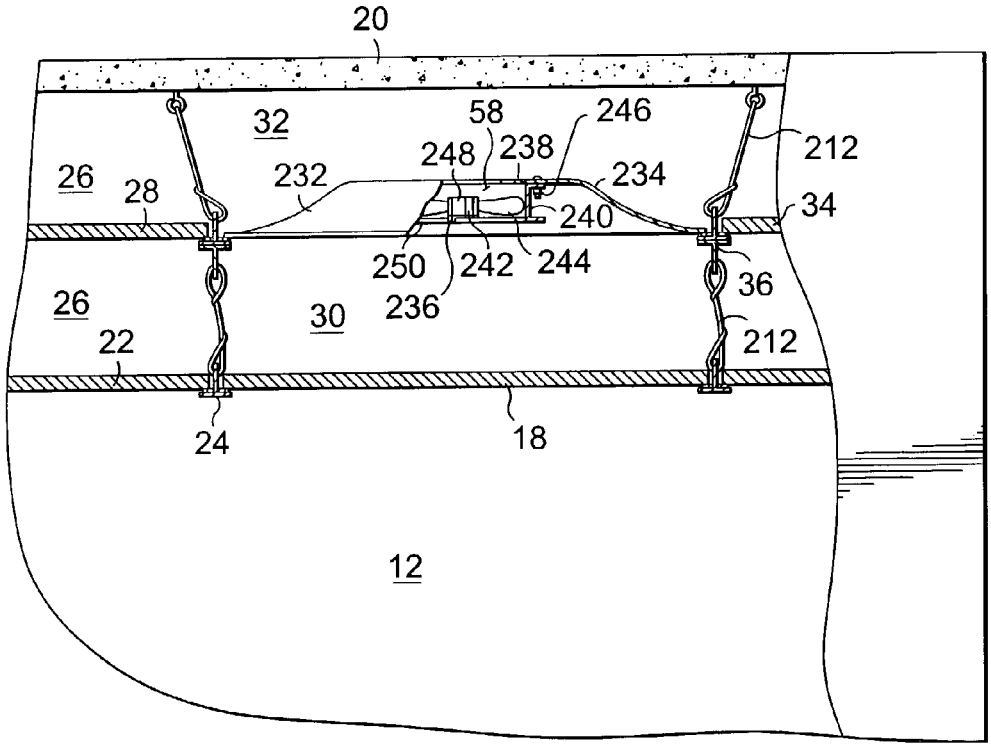
FIG. 15 is a fragmentary elevational view on an enlarged scale of a bypass apparatus, depicted diagrammatically in FIG. 1 and taken generally in the area identified by numeral 15 in FIG. 1 with portions thereof cut away for clarity, that can be provided between the return plenum and the supply plenum in an air delivery system constructed according to the present invention.
Figure 16:
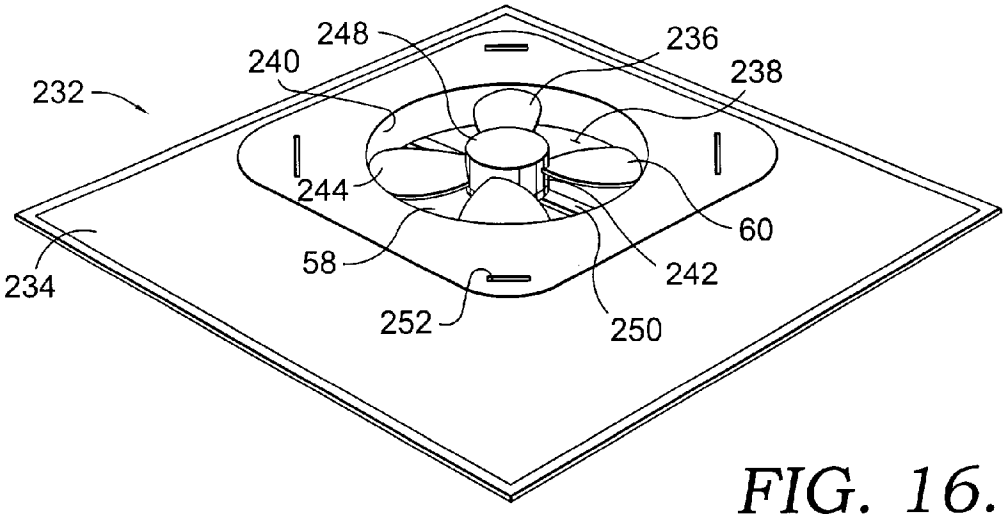
FIG. 16 is a perspective view of the bypass apparatus depicted in FIG. 15.

FIG. 3 depicts an alternative embodiment of the invention that includes only a supply plenum 30 in the interstitial space 26. The return system includes a return register 62 that may be located anywhere in the room 12 and connects with return ductwork 64 extending to the air handling unit 38 and the intake side of the fan 40. The conditioned air is supplied to the room 12 from the supply plenum 30 through an air register 66 installed in the ceiling 18. The register 66 is equipped with a fan 68 having its intake side connected with the supply plenum 30. The register 66 can be used to provide the bypass path 58 and fan 60 shown in FIG. 1. FIGS. 15 and 16 provide enlarged and more detailed views of an embodiment of the register 66 of FIG. 3.

In the system of FIG. 3, blower 40 maintains the supply plenum 30 at a pressure of zero gauge. When the thermostat calls for conditioned air into the room 12, the fan 68 is activated to force air from the plenum 30 out into the room 12 through the register 66. Return air is drawn into the return register 62 and directed back to the intake side of the fan 40 through the return ductwork 64. A lower portion of the register 66 is covered by a grill 70.

Figure 4:
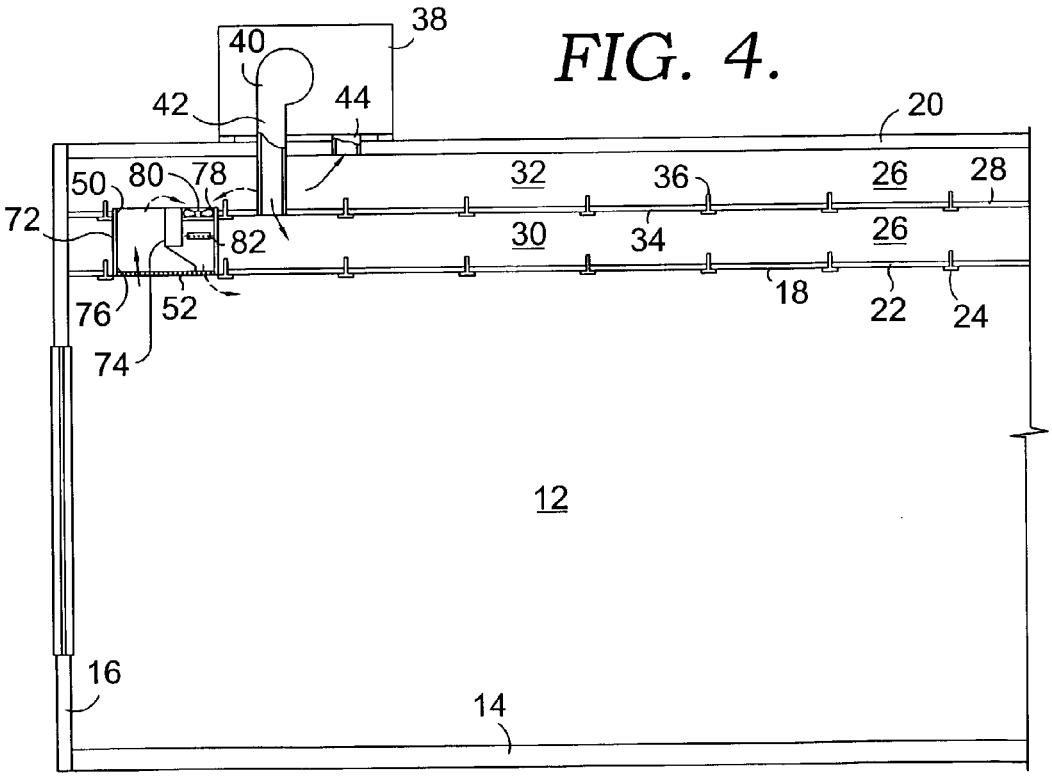
FIG. 4 is a fragmentary elevational view similar to FIGS. 1–3 diagrammatically illustrating an air delivery system constructed according to another embodiment of the invention.
Figure 27:
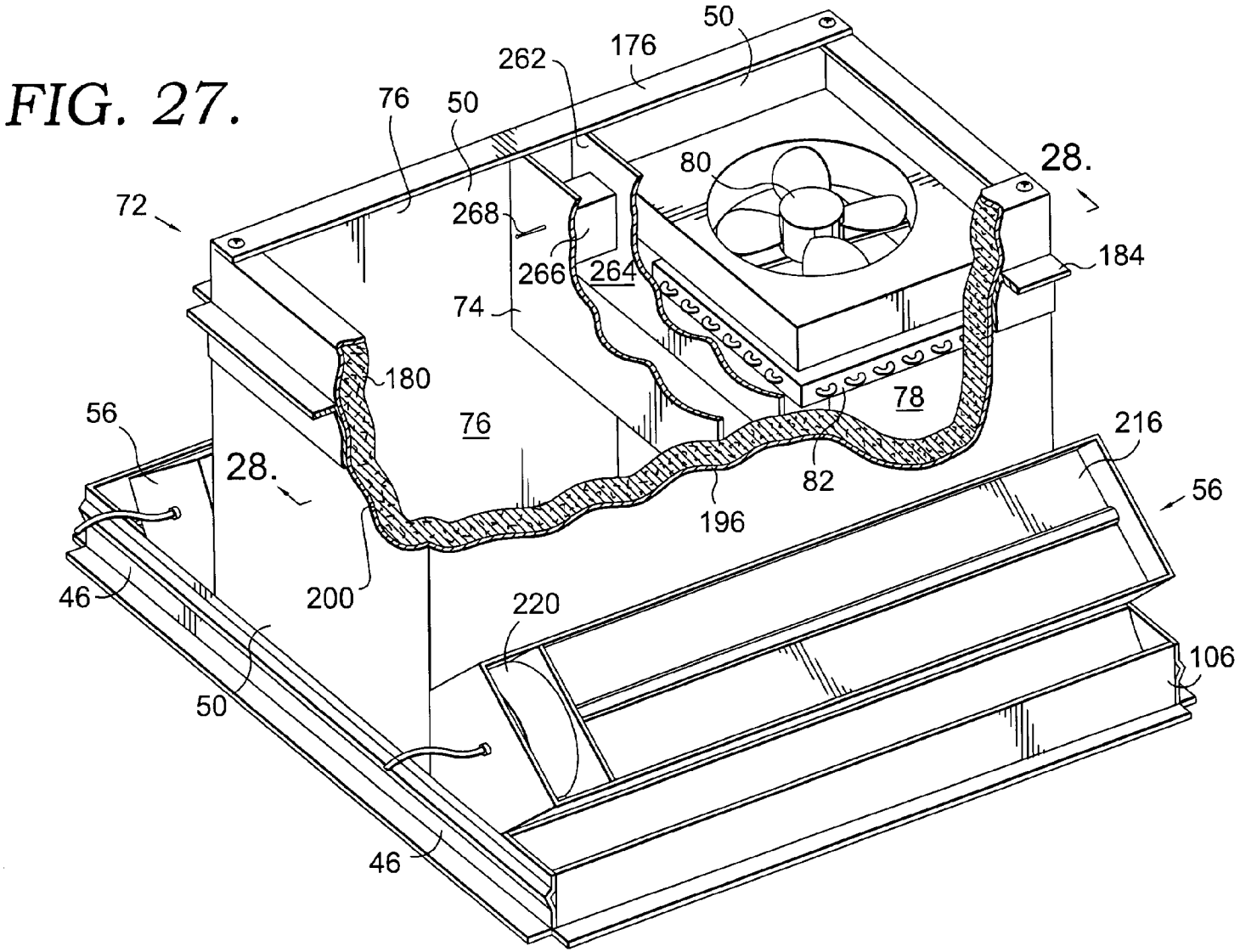
FIG. 27 is a perspective view of a modified combination supply/return fixture with a heating system incorporated as depicted diagrammatically in the delivery system illustrated in FIG. 4.

FIG. 4 depicts another embodiment of the invention that makes use of dual plenums 30 and 32 in the interstitial space 26. The system of FIG. 4 is similar to that of FIG. 1 or 2, except that a modified supply/return fixture 72 is used in the FIG. 4 embodiment instead of the fixture 48. The modified supply/return fixture 72 is essentially the same as the fixture 48 except that additional items have been added in the vertical air return conduit 50. As with the fixture 48, the fixture 72 includes one or more air diffusers 46 (best illustrated in FIG. 27) that discharge conditioned air from the supply plenum 30 into the room 12. The fixture 72 illustrated in FIG. 4 is rotated 90° from the view of the fixture 48 illustrated in FIGS. 1 and 2 to permit better viewing of the differences inside the return conduit 50. Accordingly, one of the diffusers 46 may be positioned behind the illustrated conduit 50 and one may be positioned in front of the illustrated conduit 50. FIG. 27 provides an enlarged and more detailed view of an embodiment of the fixture 72 of FIG. 4.

To modify the fixture 48 to make the fixture 72, a divider 74 is placed in the return conduit 50. The divider 74 divides the return conduit 50 into a return air conduit 76 and a heated air supply passage 78. The grill 52 is placed at a lower end of the conduit 50 adjacent to the ceiling 18. The fixture 72 further includes a fan 80 having its intake side connected with the return plenum 32 and its discharge side directing air back into the room 12. A heating coil 82 may be provided between the fan 80 and the grill 52. The coil 82 may be an electric coil, a steam coil or any other suitable type of heating device that is activated in the heating mode of the system.

Cooled conditioned air from the supply plenum 30 passes through the air diffusers 46 (obstructed in FIG. 4) and into the room 12 (in the method described above for FIG. 1 or 2, depending on whether it is a constant volume or variable volume system). When cooling is called for by the thermostat, the fan 80 and heating coil 82 are inactive in the cooling mode. The relatively negative pressure in the return plenum 32 causes return air to be drawn through the grill 52 and the return conduit 50 into the return plenum 32 from which the return air is returned through conduit 44 to the intake side of the blower 40.

When the thermostat calls for heat, the fan 80 and heating coil 82 are activated and the fan 80 operates to draw air from the return plenum 32 into the heated air supply passage 78 past the heating coil 82 and into the room 12 through the grill 52. Return air then moves from the room 12 to the return plenum 32 through the return air conduit 76. In this manner, heated or cooled air can be supplied to the room under the control of the thermostat. The dashed arrows in FIG. 4 illustrate the path air flows when the fan 80 is on in the heating mode.

Figure 5:
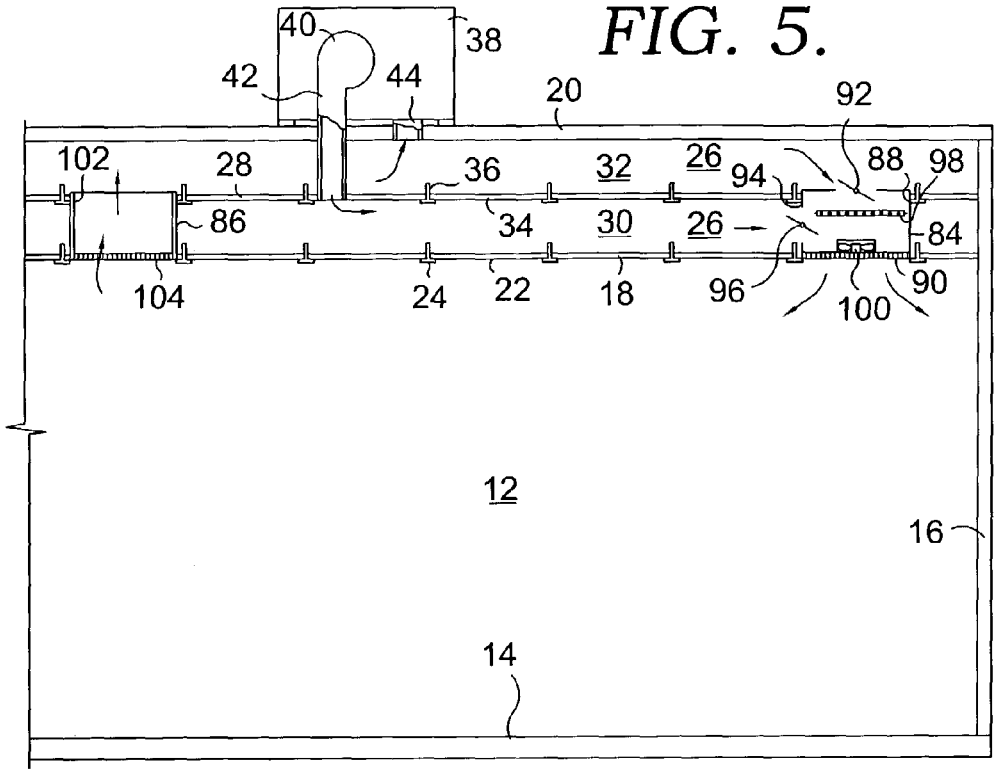
FIG. 5 is a fragmentary elevational view similar to FIGS. 1–4 diagrammatically illustrating an air delivery system constructed according to another embodiment of the invention.

FIG. 5 depicts an alternative embodiment of an air delivery system that makes use of the dual plenums 30 and 32. In the system of FIG. 5, a supply fixture 84 is provided along with a separate return fixture 86. The supply fixture 84 includes a conduit 88 that extends from a supply register 90 to the return plenum 32. The upper end of the conduit 86 opens into the return plenum 32 and is provided with a damper 92 that opens and closes the upper end of the conduit 88. The conduit 88 also has an opening 94 that connects with the supply plenum 30 and is provided with a damper 96 for opening and closing the opening 94. A heating coil 98 is provided in the conduit 88. A fan 100 may be operated under thermostat control to direct air through conduit 88 from the return plenum 32 into the room 12 through the air register 90.

The return fixture 86 includes a return conduit 102 having a grill 104 on its lower end adjacent to the ceiling 18. The conduit 102 extends from the grill 104 to the return plenum 32 in order to deliver return air to the return plenum. Various embodiments of the return conduit 102 are discussed in greater detail below. In the system of FIG. 5, both the supply plenum 30 and the return plenum 32 are maintained at a pressure of zero gauge.

In the cooling mode of operation, the system of FIG. 5 causes the damper 96 to open and the damper 92 to close. The blower 40 operates to supply conditioned air to the supply plenum 30 and from the supply plenum through opening 94, into the fixture 84, through the register 90 and into the room 12. Return air is drawn through the grill 104 and through conduit 102 to the return plenum 32 and from the return plenum through conduit 44 to the intake side of the blower 40.

In the heating mode of operation, damper 96 is closed and damper 92 is opened. The heating coil 98 and fan 100 are activated to force air from the return plenum 32 downwardly through conduit 88 past the heating coil 98 and into the room 12 through the register 90. In this manner, the air is heated by the coil 98 and delivered into the room. Return air is drawn into the return plenum 32 through the grill 104 and the return conduit 102. Both dampers 92, 96 are illustrated in FIG. 5 in a partially open position for ease of viewing only and, as discussed above, would not otherwise both be open during operation.

Figure 6:
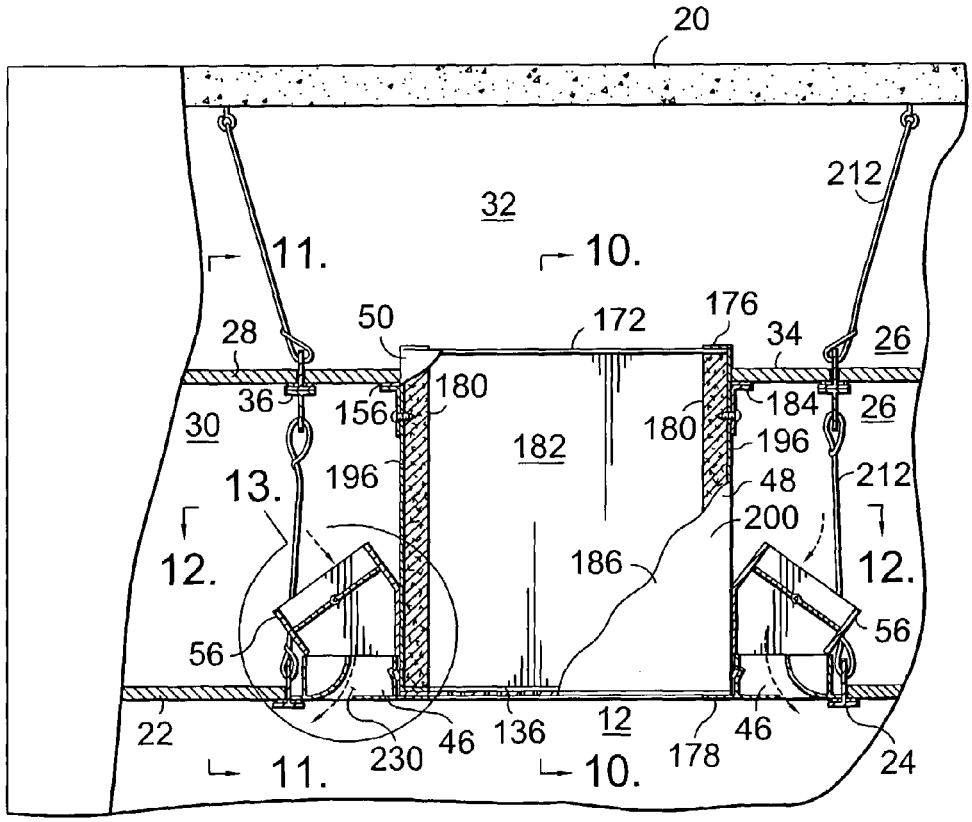
FIG. 6 is a fragmentary elevational view on an enlarged scale of the combination supply/return fixture depicted diagrammatically in FIG. 1 and taken generally in the area identified by numeral 6 in FIG. 1 with portions thereof cut away for clarity.

FIG. 6 illustrates a more detailed view of the combined supply and return fixture 48. In the particular embodiment illustrated in FIG. 6, the fixture 48 includes two diffusers 46 for directing the flow of air from the supply plenum 30 into the room 12. Each of the diffusers 46 also includes a terminal unit 56 associated therewith for selectively controlling the flow of the air from the supply plenum 30 to the room 12. The fixture 48 also includes the return conduit or chimney 50 located therebetween for permitting the movement of air from the room 12 to the return plenum 32.

Figure 7:
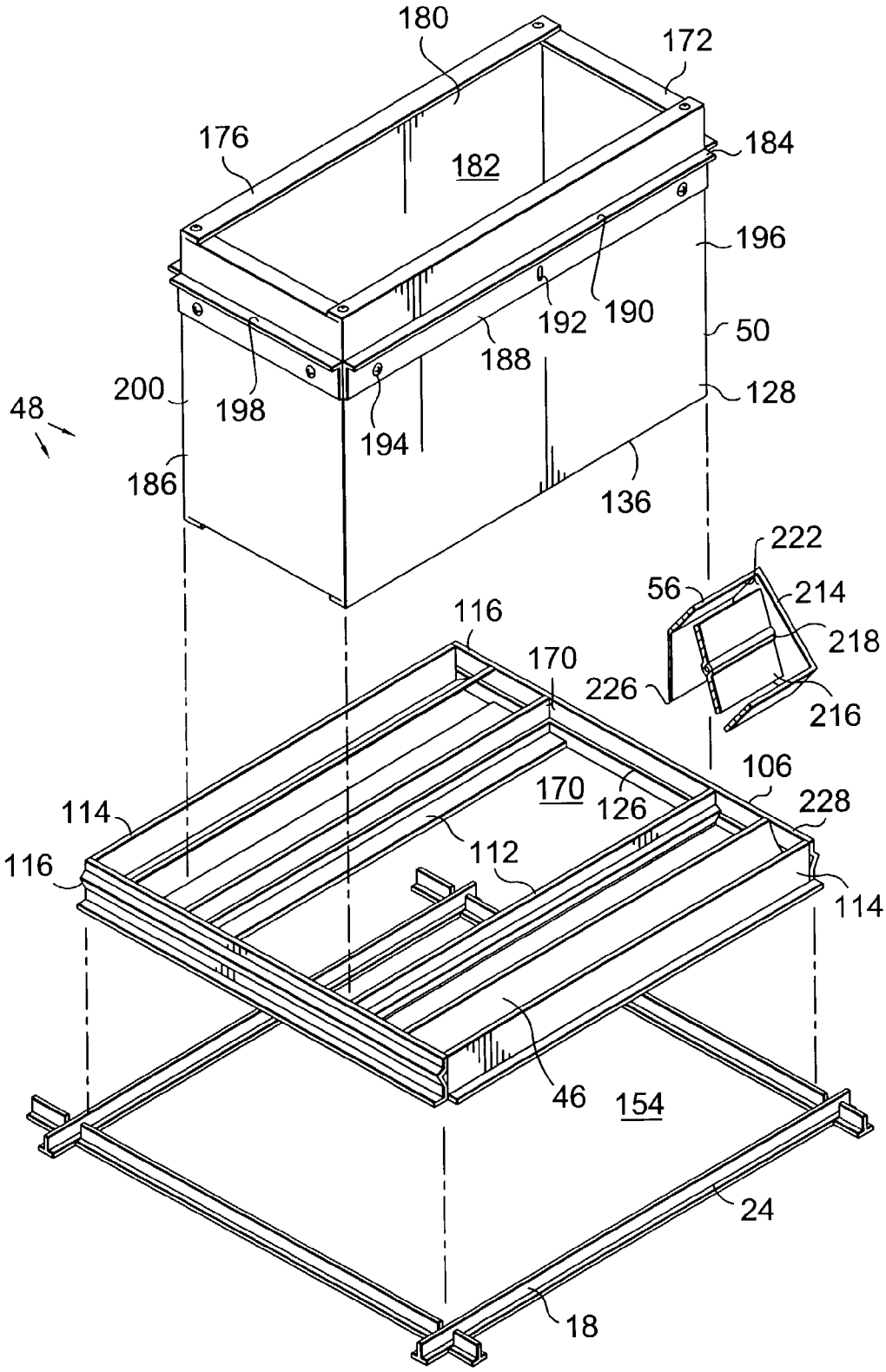
FIG. 7 is an exploded perspective view of the combination supply/return fixture of FIG. 6 that may be used in an air delivery system constructed according to the present invention.

The diffusers 46 are preferably part of a base unit 106 (best illustrated in FIG. 7) upon which a modular apparatus is designed whereby a user can mix and match various components to customize the apparatus depending on the user's particular needs. The base unit 106 preferably includes, in the illustrated embodiment, the two diffusers 46. The particular embodiment of the base unit 106 illustrated in FIG. 7 is preferably constructed by assembling six sections of extruded aluminum members 110. While the members 110 have been indicated to be aluminum, it is well within the scope of the present invention to have the members be of a different material. Similarly, while the members 110 have been indicated to be manufactured by an extrusion process, other manufacturing processes are capable of providing the members 110 in their desired shapes, are well within the scope of the present invention and would be readily understood by one of ordinary skill in the art. Likewise, the base unit could be formed as a single integral piece.

Figure 8:
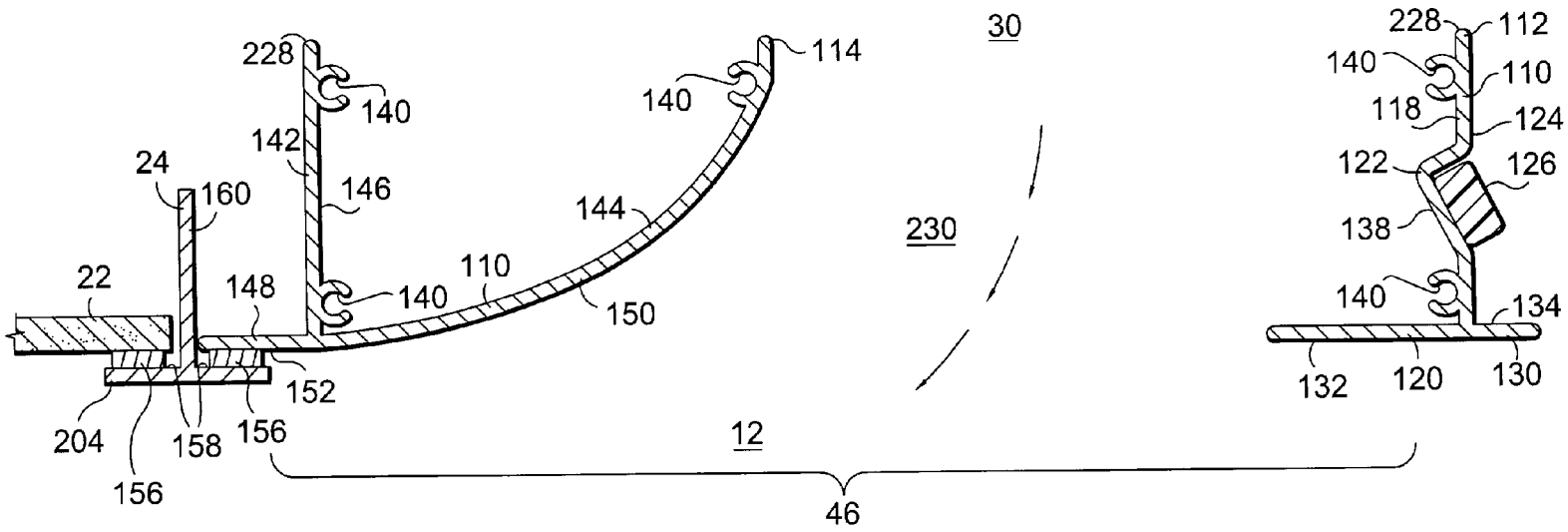
FIG. 8 is a fragmentary sectional view on an enlarged scale of a diffuser of the combination supply/return fixture of FIG. 6.

When constructed in accordance with the illustrated embodiment, the base unit 106 includes two interior sections 112, two arced sections 114, and two end sections 116. As best illustrated in FIG. 8, the interior sections 112 have a generally upside down T-shaped cross-section. The interior section has a vertical wall 118 which is generally perpendicular to a horizontal base 120. The vertical wall 118 includes a jog 122 on an inner surface 124 thereof. The jog 122 is for receiving a gasket 126 to form a seal against an outer surface 128 of the conduit 50 when the conduit 50 is received in the base unit 106.

The base 120 of the interior section 112 includes a inner section 130 and an outer section 132. The inner section 130 includes upper surface 134 that provides a ledge upon which a lower end 136 of the return conduit 50 rests during use.

The vertical wall 118 has an outer surface 138. When the interior section 112 is extruded in accordance with an embodiment of the present invention, the outer surface 138 can be provided with screw bosses 140. The outer section 132 of the base 120 helps direct the flow of air from the supply plenum 30 into the room 12.

The arced sections 114 include a vertical wall 142 and a generally arcuate wall 144. In the embodiment illustrated, an inner surface 146 of the vertical wall 142 can be provided with screw bosses 140 to assist in assembly. The arcuate wall 144 has an outer section 148 and an inner section 150. The outer section 148 is preferably perpendicular to the vertical wall 142 and includes a lower surface 152. During use, when the base unit 106 is received in an opening 154 in the grid work of T-bars 24 in the ceiling 18, a gasket 156 is positioned between the lower surface 152 of the outer section 148 and an upper surface 158 of the T-bar 24. The gasket 156 can also be used on the upper surface 158 on an opposite side of the T-bars vertical member 160. In this manner, the gasket 156 seals the tiles 22 to the T-bars 24 in an airtight manner to provide an airtight seal between the room 12 and the supply plenum 30. Similarly, the gaskets 156 can be used on the crosses 36 in the partition 28, as discussed in greater detail below.

Figure 9:
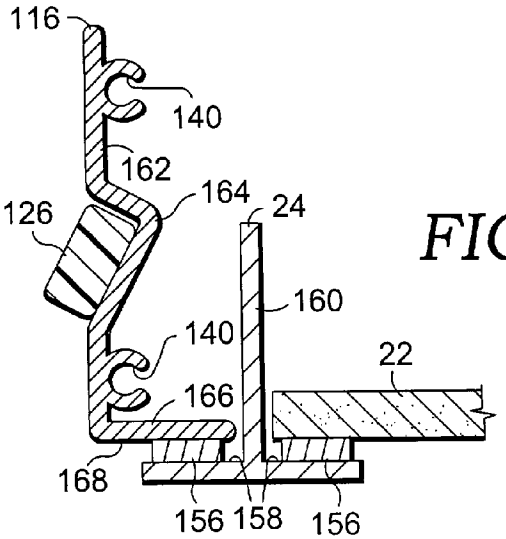
FIG. 9 is a sectional view of an extruded member that forms ends of the diffuser of FIG. 9.

The end sections 116, as best viewed in FIG. 9, have a vertical wall 162 that is substantially the same as the vertical wall 118 of the interior sections 112. Consequently, the vertical wall 162 includes a jog 164 therein and corresponds with the jog 122 for receiving the gasket 126. The vertical wall 162 also preferably has the screw bosses 140 extruded therein. The end section 116 has a base 166 with a lower surface 168. When the base unit 106 is received in the opening 154, the end sections 116 are supported by the T-bars 24 by the base 166 resting on a gasket 156 placed on the upper surface 158 of the T-bar.

When the six extruded members 110 are assembled in the manner illustrated in FIG. 7 to provide the base unit 106, the two interior sections 112 and the two end sections 116 cooperate to define a center section 170 of the base unit 106. The jogs 122, 164 with the gasket 126 therein cooperate to define a seal around a periphery of the center section 170. When the user desires to both supply air from the supply plenum 30 and return room air to the return plenum 32 in the same apparatus, as in the combination supply return fixture 48, the air return conduit 50 is received in the center section 170. The gasket 126 encircles the conduit 50 to seal off the supply plenum 30 so that the conduit 50 provides a sealed passage through the supply plenum 30 while maintaining its integrity.

The conduit 50 is preferably a rectangular structure formed by bending sheet metal into a desired orientation. The conduit has an upper end 172 which protrudes into the return plenum 32 and the lower end 136 that is received in the center section 170 of the base unit 106. Portions of the conduit 50 at its ends 172, 136 are preferably bent inward to provide upper and lower flanges 176, 178 respectively. The flanges 176, 178 not only provide structural rigidity to the conduit 50, but they also define a space for receiving insulation 180. The insulation can be sheets of duct liner that is well known in the art and readily available. The insulation 180 provides a thermal barrier between a return passage 182, defined by the conduit 50, and the supply plenum 30.

Figure 10:
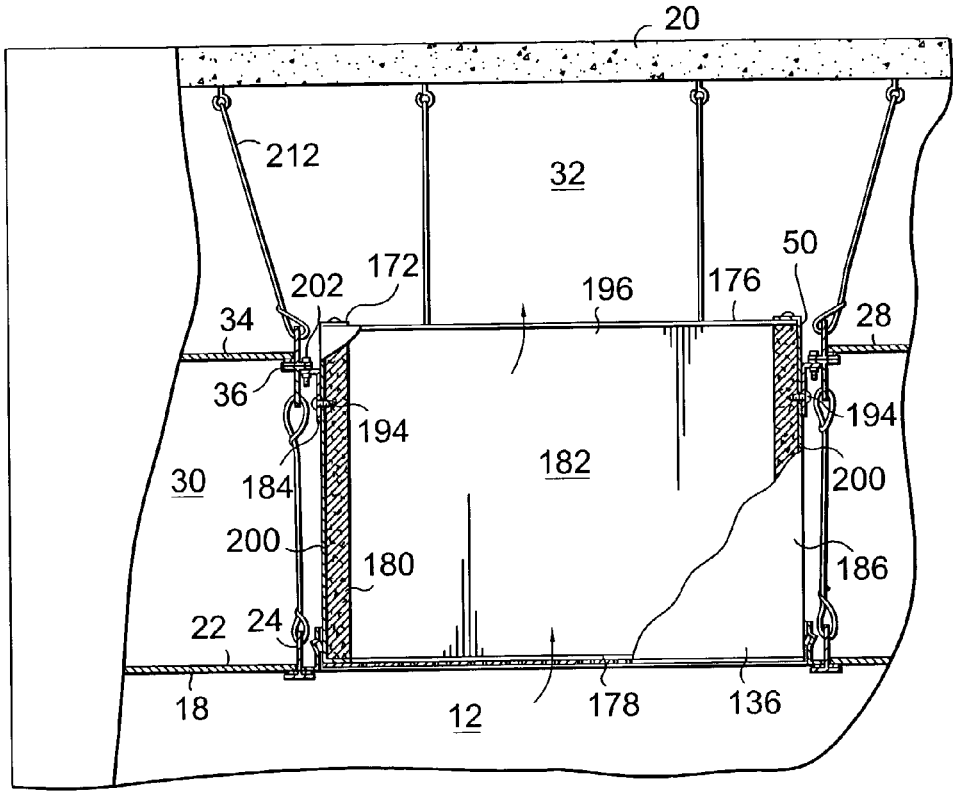
FIG. 10 is a fragmentary sectional view of the combination supply/return fixture taken generally along line 10—10 of FIG. 6 in the direction of the arrows.

As best illustrated in FIGS. 6, 7 and 10, a mounting angle 184 is mechanically coupled to an outer surface 186 of the conduit 50. The mounting angle 184 has a vertical portion 188 and a horizontal portion 190. The vertical portion 188 is provided with a plurality of apertures 192 for receiving mounting screws 194 therethrough to couple the mounting angle 184 with the conduit 50. The apertures 192 can be oblong or oval in nature in the vertical orientation to permit the user to adjust the mounting angle 184 to accommodate variations in the spacing between the ceiling 18 and the partition 28. The sections of mounting angle 184 provided on side walls 196 of the conduit 50 can be provided with a gasket 156 on an upper surface 198 of the horizontal portion 190 of the mounting angle 184. A rectangular piece of tile 34 rests thereon and extends between the conduit 50 and the adjacent cross 36 in the partition 28, as best illustrated in FIG. 6. The sections of mounting angle 184 on end walls 200 can be directly and mechanically coupled with the adjoining crosses 36 via a rivet 202, as best illustrated in FIG. 10, without the need for a gasket therebetween.

Figure 14:
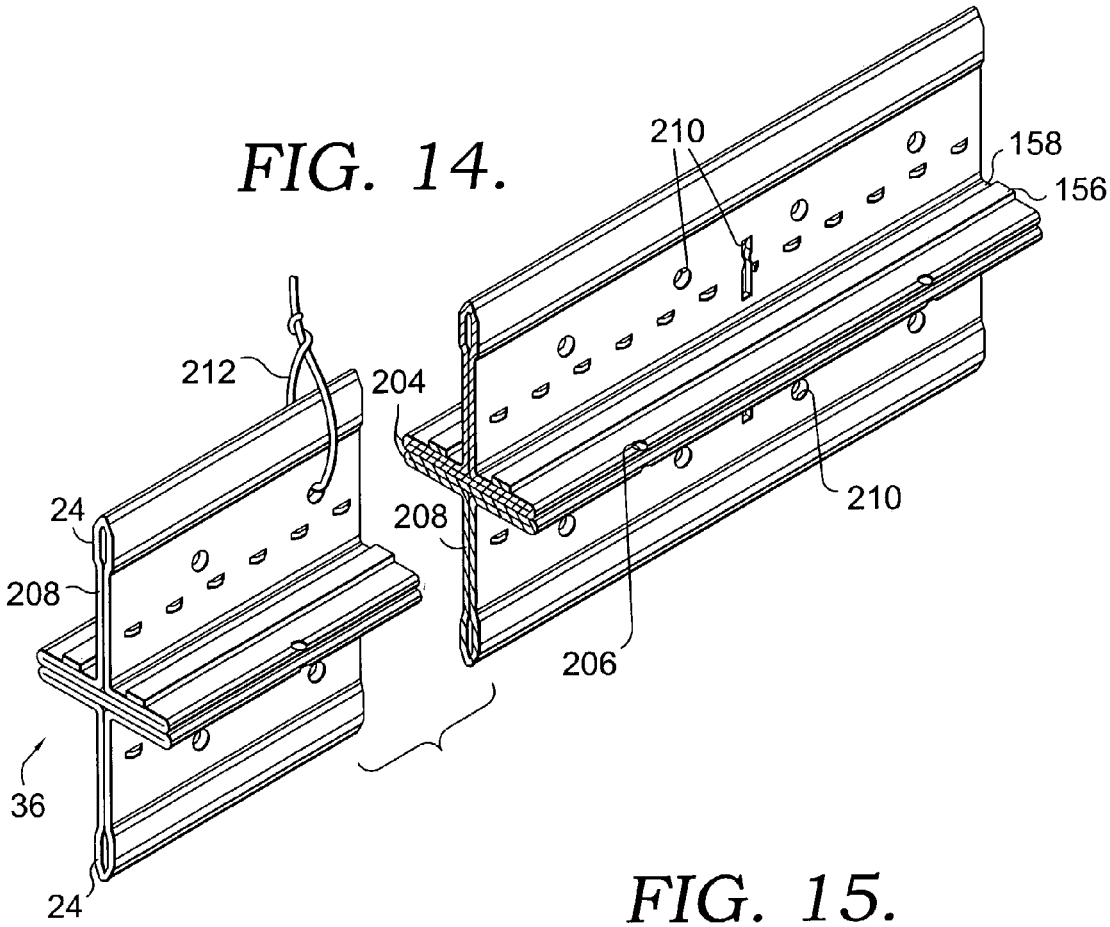
FIG. 14 is a fragmentary perspective view, partially in section, of a structural cross that can be provided in a partition constructed according to the present invention in the interstitial space to separate the supply and return plenums.

FIG. 14 illustrates a cross section of a structural cross 36 in perspective view. In the illustrated embodiment, the cross 36 is made by joining two readily available T-bars 24 together in a face-to-face relationship. One of ordinary skill in the art would readily understand that the cross 36 could easily be fabricated as a single integral piece with a roll forming machine and a series of punches made therein. However, the use of two T-bars 24 joined in the manner illustrated has been found a cost effective alternative. The two T-bars 24 are joined by pinching or crimping horizontal portions 204 of the T-bars 24 together at regularly spaced intervals, for example every six inches, to form a crimp 206. It is readily understood that the two members could also be joined by other known fastening means, such as rivets. A vertical portion 208 of the T-bars 24 and/or crosses 36 includes a plurality of holes 210 therethrough for receiving support wires 212 or ends of T-bars 24 that connect thereto in any of the common methods presently in use in the art. A gasket 156 is placed on the upper surface 158 where needed (i.e., when a tile 34 rests thereon).

While the illustrated embodiment discloses the cross 36 for use in forming the grid work for the partition 28, it is within the scope of the present invention to use a standard T-bar 24 in the partition 28. In such case, a modified support wire (not shown) could be employed to suspend the ceiling 18 from the T-bars 24 in the partition 28. In such an embodiment, the modified support wire could take the shape of a strip of sheet metal bent to hook around the horizontal portion 204 of the T-bar 24. However, the illustrated embodiment has been found beneficial in maintaining the integrity of the seal between the partition tiles 34 and the crosses 36.

Figure 11:
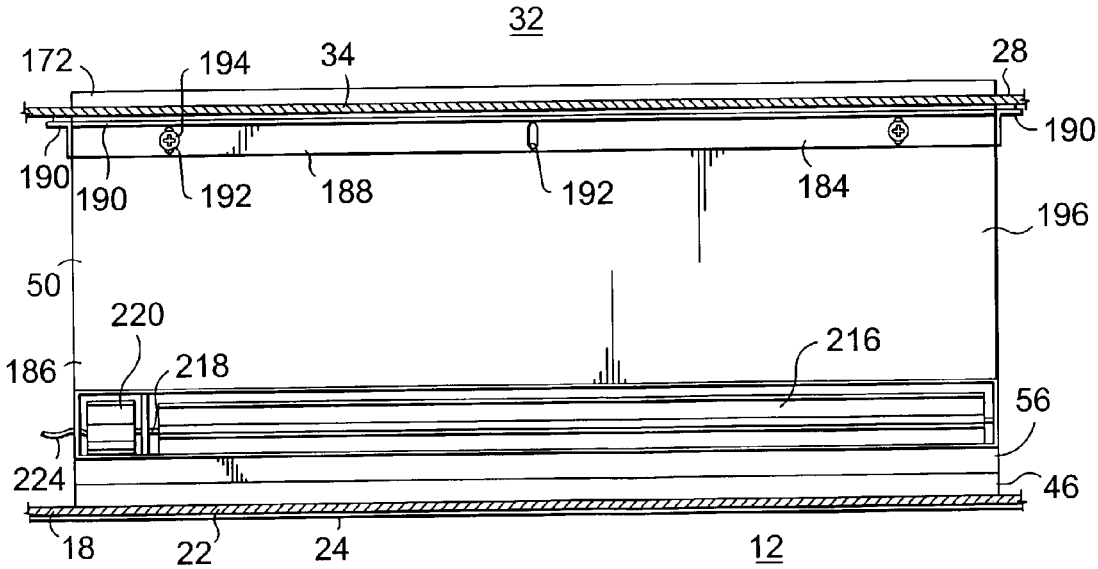
FIG. 11 is a fragmentary side elevational view of the combination supply/return fixture taken generally along line 11—11 of FIG. 6 in the direction of the arrows.
Figure 12:
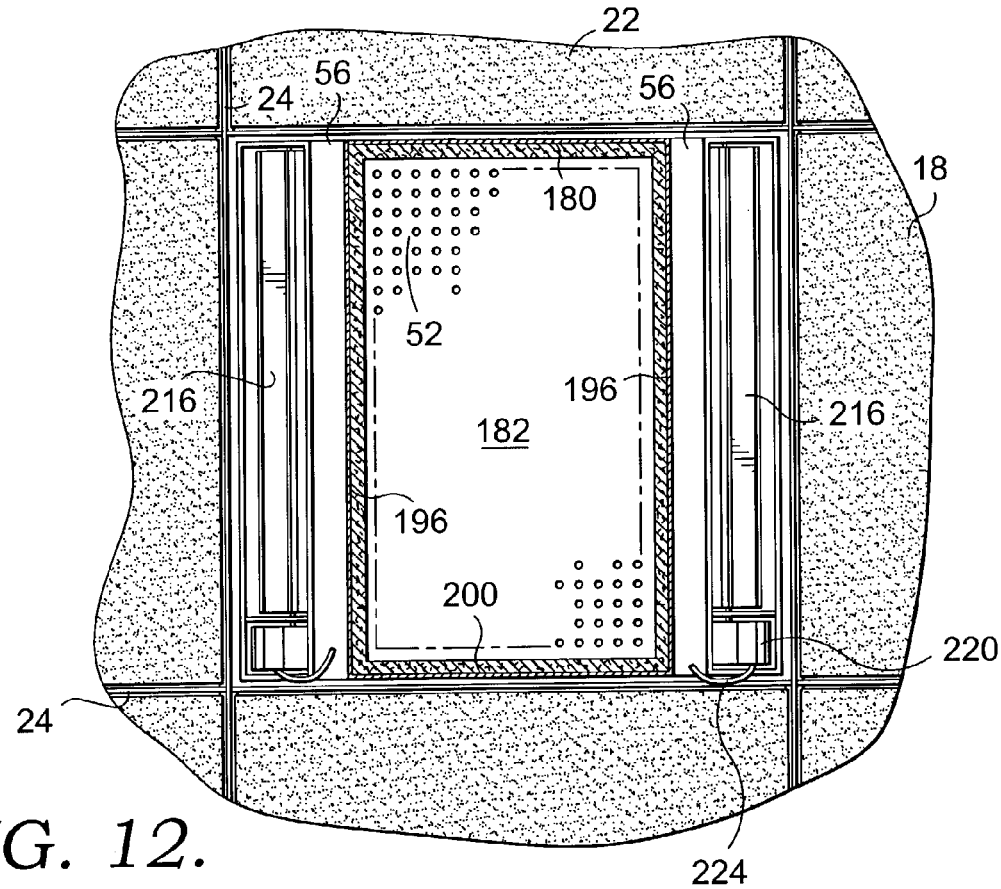
FIG. 12 a fragmentary top plan view, partially in section, of the combination supply/return fixture taken generally along line 12—12 of FIG. 6 in the direction of the arrows.
Figure 13:
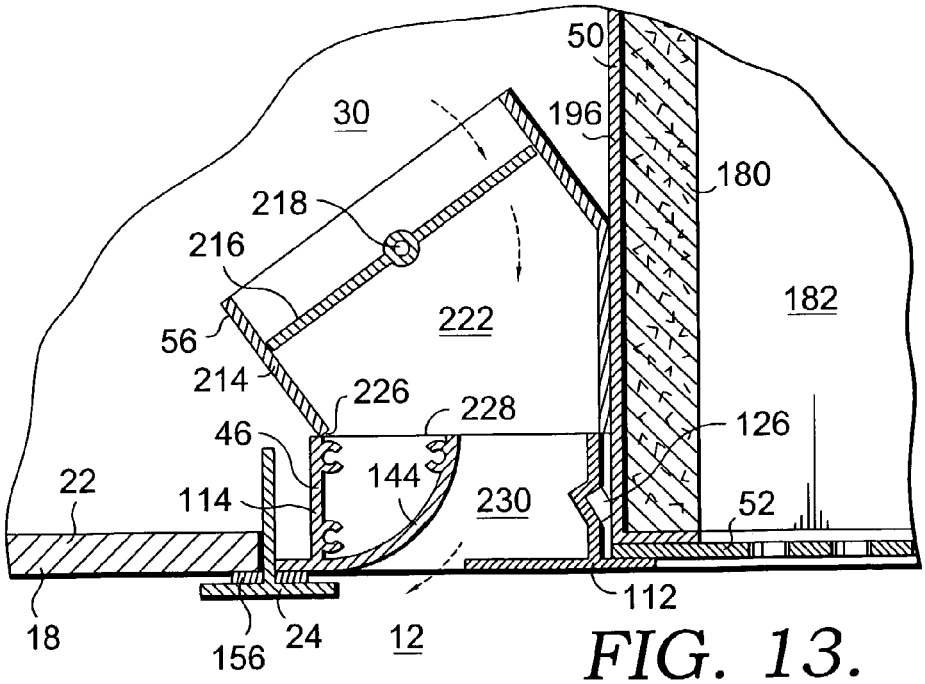
FIG. 13 is a fragmentary sectional view on an enlarged scale taken generally in the area identified by numeral 13 in FIG. 6 illustrating the diffuser with a terminal unit associated therewith.

The terminal units 56 may be of the type more fully disclosed in the above-referenced pending patent application. The units 56, as illustrated in FIG. 13, preferably include a housing 214 for supporting a damper blade 216 on a horizontal shaft 218. As the shaft 218 is turned, the damper blade 216 rotate between fully open and fully closed positions. A motor 220 (FIGS. 11 and 12) for rotating the damper blade 216 may also be mounted in the housing 214. The motor can be of the type more fully described in the above-referenced pending patent application. The motor 220 may alternatively be mounted on the outside of the housing 214 to permit the damper blade 216 to run the length of the housing 214. As will be readily understood, the housing 214 defines an opening 222 through which supply air from the supply plenum 30 passes when the damper blade 216 is in an open position. Power can be provided to the motor 220 by way of electrical wires 224.

The housing 214 is constructed with a lower portion 226 designed to permit coupling of the terminal unit 56 to an upper surface 228 of a diffuser 46 when the user desires a variable volume system as illustrated in FIG. 1. When the damper blade 216 is in its open position, supply air moves from the supply plenum 30 through the opening 222 in the terminal unit, then through an opening 230 in the diffusers 46 and into the room 12. The opening 230 in the diffuser 46 through which the supply air passes is defined on one side by the arcuate wall 144 of the arced section 114, on the other side by the interior section 112 and on the ends by the end sections 116.

FIG. 15 illustrates an enlarged and more detailed view of the bypass path 58 between the return plenum 32 and the supply plenum 30 of FIG. 1. A partition tile 34 is replaced by a bypass apparatus 232 to provide the bypass path 58 in the partition 28. The bypass apparatus 232 includes a hood 234 and a fan unit 236. The fan unit 236 can be the fan 60 illustrated in FIG. 1. The hood 234 can be dome shaped with a central opening 238 therein to permit air to pass through the hood 234. The fan unit 236 preferably includes a housing 240, a motor 242 and blades 244.

In the illustrated embodiment, the opening 238 in the hood 234 is preferably cylindrical. Accordingly, the housing 240 for the fan unit 236 is also preferably cylindrical. The cylindrical housing 240 has annular flanges 246 that permit mechanically coupling the fan unit 236 to the hood 234. The motor 242 is an axial motor and is located in a hub 248 from which the blades 244 extend radially outward. The motor 242 is supported by brackets 250. While the hood 234 of the bypass apparatus 232 has been illustrated as being dome shaped, the hood could be flat in nature with the housing 240 mounted on upper or lower surfaces of the hood 234, as discussed below.

The hood 234 can be provided with hanger holes 252 (FIG. 16) to permit coupling of support wires 212 thereto so a user may suspend the bypass apparatus 232 directly from the roof 20 when local codes require independent suspension or support of non-tile items placed in a suspended grid work. Along those lines, the upper end 172 of the conduit 50 could similarly be provided with hanger holes 252 (not shown) to permit suspending it directly from the roof 20 where codes so require. The bypass apparatus 232 can be used in the system illustrated in FIG. 3 and can be the air register 66.

FIG. 2 illustrates a combination supply and return fixture 48 that is slightly different than the combination supply and return fixture 48 illustrated in FIG. 1. In FIG. 1, as discussed above, the combination supply and return fixture 48 is in use in a variable volume system whereas the combination supply and return fixture 48 in FIG. 2 is in use in a constant volume system. Accordingly, the fixture 48 illustrated in FIG. 2 does not require the presence of a terminal unit 56 to control the flow of air from the supply plenum 30 to the room 12.

Figure 17:
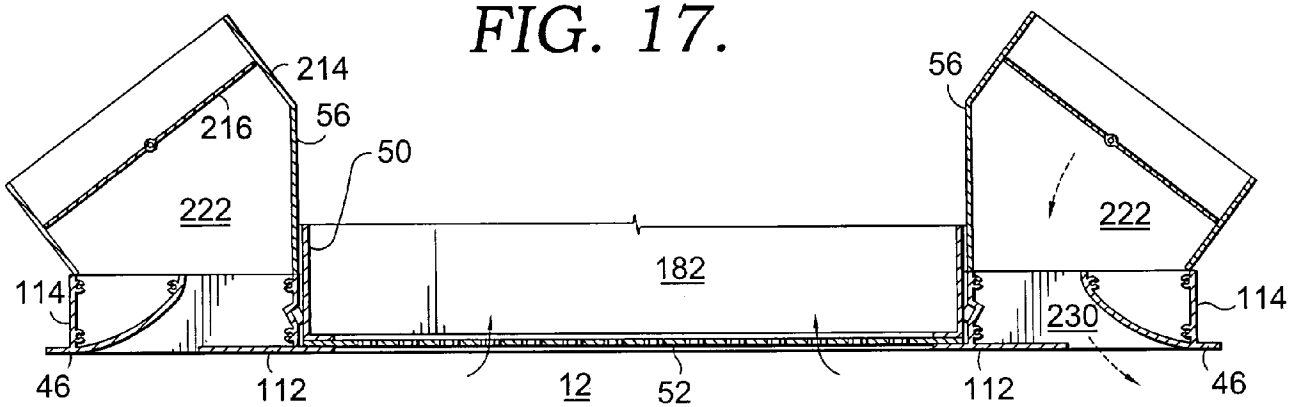
FIG. 17 is fragmentary sectional view of the combination supply/return fixture of FIG. 6 illustrating a dual supply with terminal units and with a return for use in a variable volume system.

A beneficial feature of the combined supply/return fixture 48 is its modular design. FIGS. 17–26 illustrate a number of variations that can be made to the fixture 48. FIG. 17, for example, illustrates the fixture 48 with a dual supply and a return for use in a variable volume system as illustrated in FIGS. 1, 6 and 7.

Figure 18:
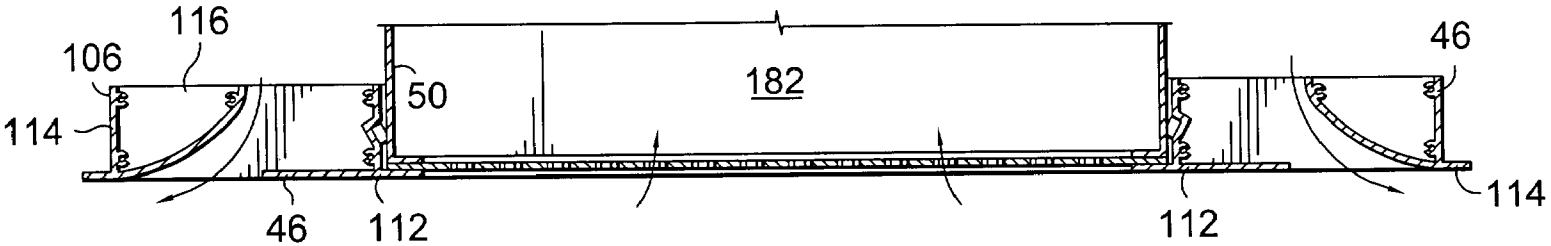
FIG. 18 is fragmentary sectional view of the fixture modified to provide a dual supply with a return and with the terminal units removed for use in a constant volume system.
Figure 19:
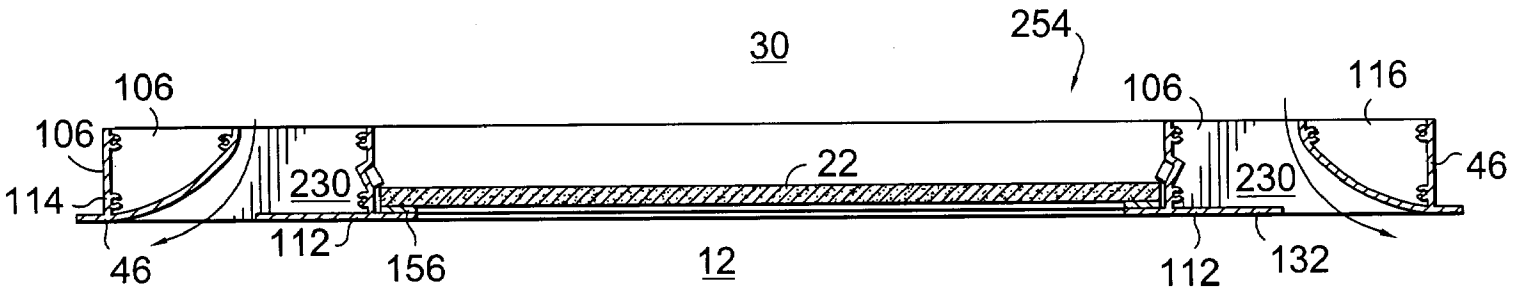
FIG. 19 is fragmentary sectional view of the fixture modified to provide a dual supply without a return and without the terminal units for use in a constant volume system.
Figure 20:
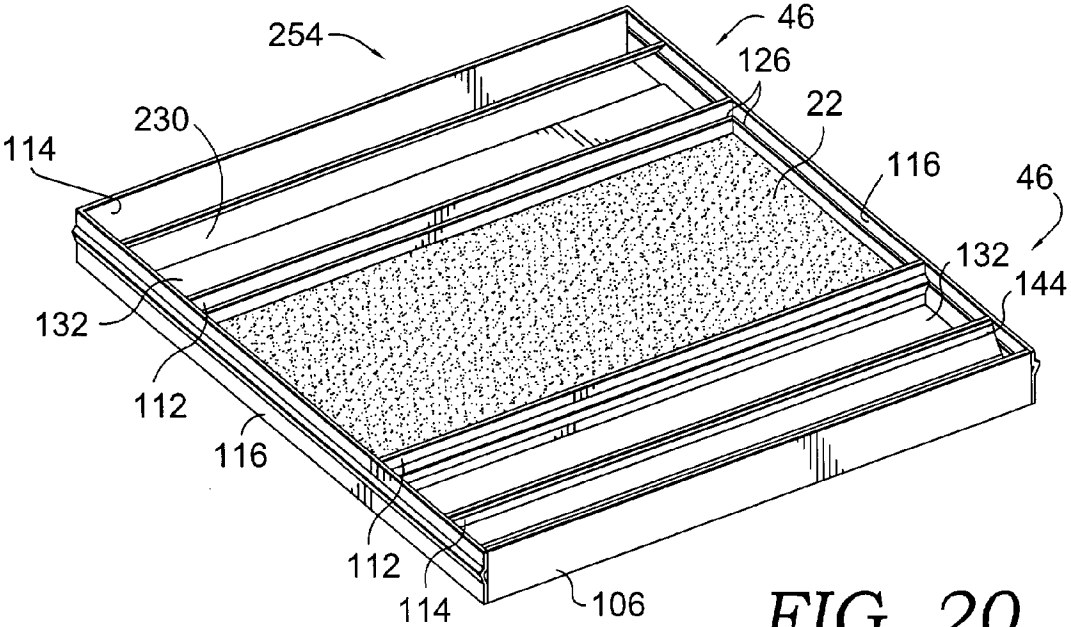
FIG. 20 is a top perspective view of the fixture depicted in FIG. 19.
Figure 21:
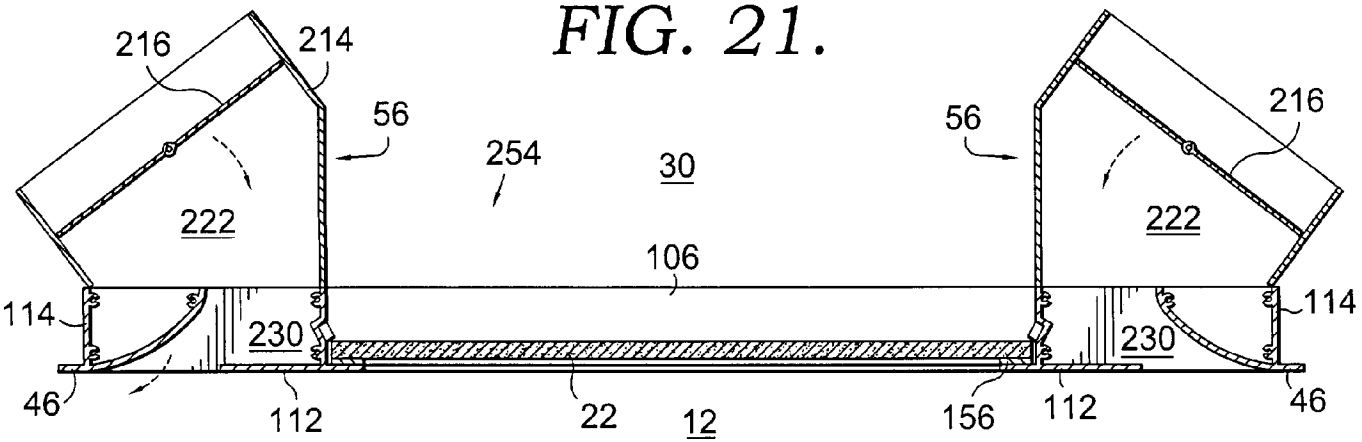
FIG. 21 is fragmentary sectional view of the fixture modified to provide a dual supply with terminal units and without a return for use in a variable volume system.

FIG. 18 illustrates the dual supply with a return fixture 48 for use in a constant volume system as illustrated in FIG. 2. In this arrangement, the user has simply removed the terminal units 56. Similarly, by removing the conduit 50 and the grill 52 from the center section 170 of the base unit 106 and replacing them with an appropriately sized ceiling tile 22, the user can easily convert the combination supply/return fixture 48 illustrated in FIG. 18 into the dual supply no return fixture 254 illustrated in FIG. 19. FIG. 20 illustrates a top perspective view of the dual supply no return fixture 254. By placing the two terminal units 56 back on the diffusers 46 of the dual supply no return fixture 254 in FIG. 19, as illustrated in FIG. 21, the user can use the fixture 254 in a variable volume system.

Figure 22:
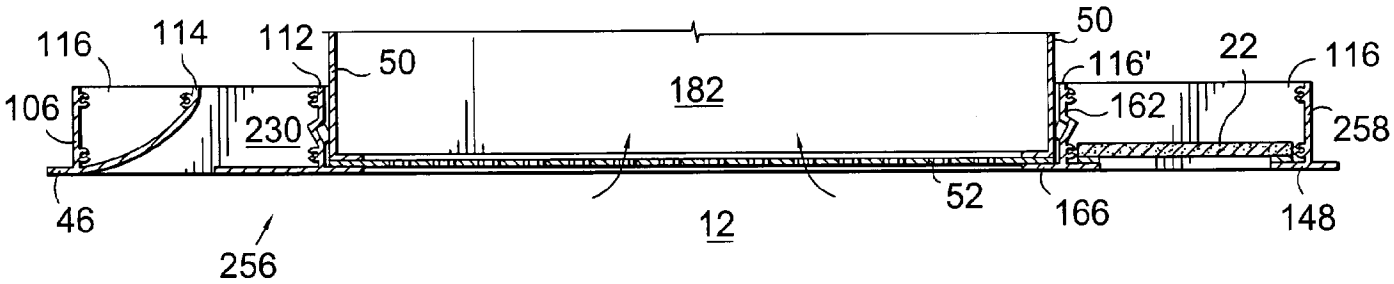
FIG. 22 is fragmentary sectional view of the fixture modified to provide a single supply without a terminal unit and with a return for use in a constant volume system.
Figure 23:
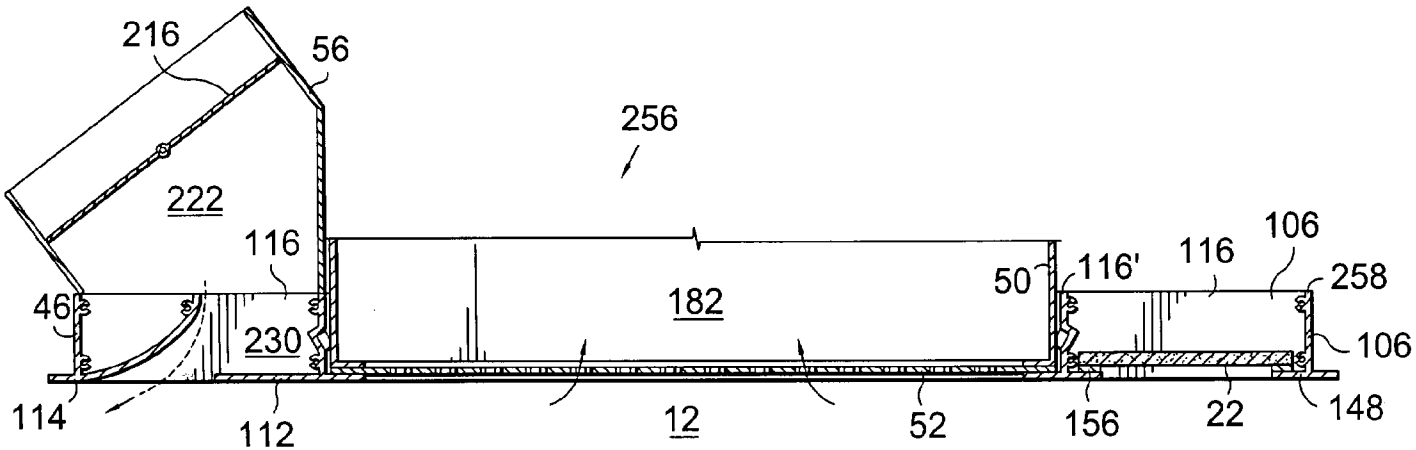
FIG. 23 is fragmentary sectional view of the fixture modified to provide a single supply with a terminal unit and with a return for use in a variable volume system.

If the user does not need to supply the volume of air to the room 12 that two diffusers 46 would supply, the user can provide a fixture with only a single diffuser as illustrated in FIGS. 22–25. FIG. 22 illustrates a single supply with return fixture 256 for use in a constant volume system. By placing a terminal unit 56 on the diffuser 46 in FIG. 22, as illustrated in FIG. 23, the single supply with return fixture 256 can be used in a variable volume system. In constructing the single supply with return fixtures 256 illustrated in FIGS. 22 and 23, one of the arced sections 114 of the base unit 106 is replaced by a modified extruded member 258. The modified extruded member 258 is essentially identical to the extruded arced section 114 but for replacing the arced inner section 150 with another outer section 148 to provide a ledge upon which an appropriately sized tile 22 may rest. Similarly, the interior section 112 on the same side where the arced section 114 was removed can be replaced by an end section 116 of appropriate length. The end section 116 can be slightly modified to include a base 166 on both sides of the vertical wall 162 and is thereby been identified by the numeral 116'. Alternatively, the interior section 112 can be left and not replaced by the modified end section 116' if desired.

Figure 24:
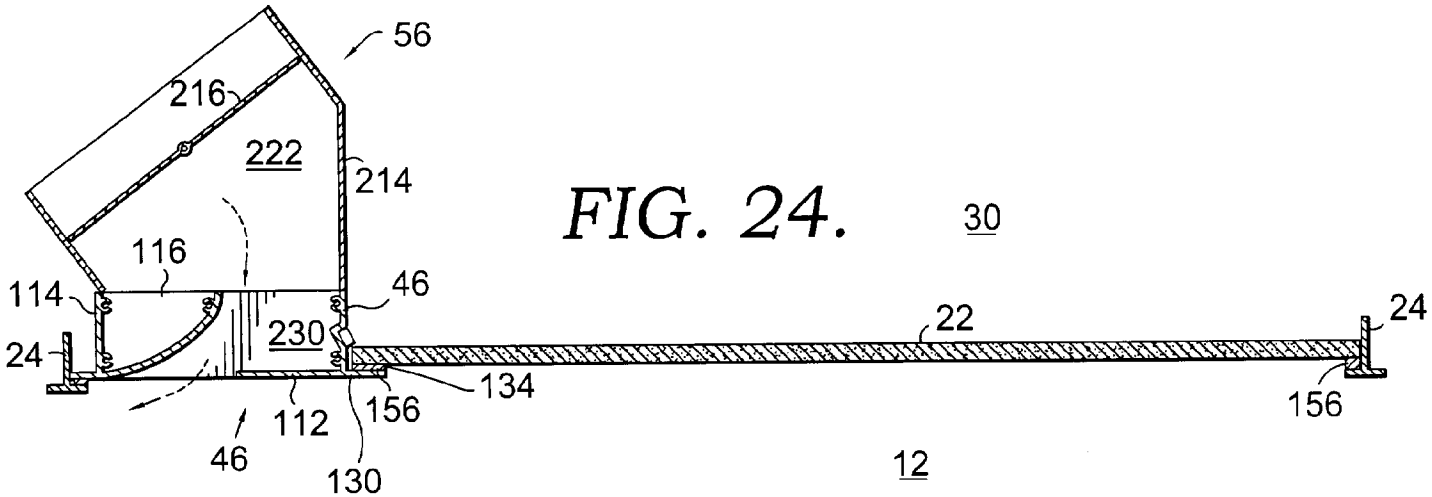
FIG. 24 is a fragmentary sectional view of the fixture modified to provide a single supply with a terminal unit and without a return for use in a variable volume system.
Figure 25:
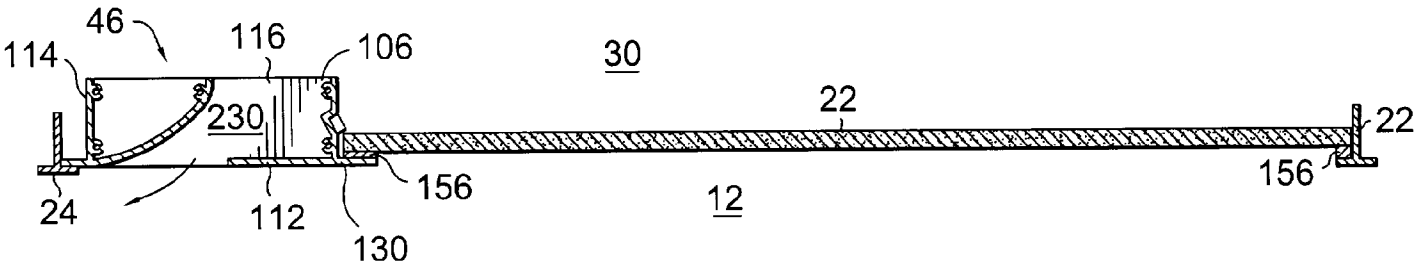
FIG. 25 is a fragmentary sectional view of the fixture modified to provide a single supply without a terminal unit and without a return for use in a constant volume system.

When the user does not need the volume of air supplied by two diffusers 46 and does not have the need for a return air passage, the user can employ the arrangement illustrated in FIGS. 24 and 25. In this arrangement, the base unit 106 has been reduced to simply a diffuser 46. The upper surface 134 of the inner section 130 which normally would support the grill 52 and the lower end 136 of the conduit 50 now supports an appropriately sized tile 22. The gasket 156 on the opposite T-bar could be made thicker to accommodate the resulting elevation difference.

Figure 26:
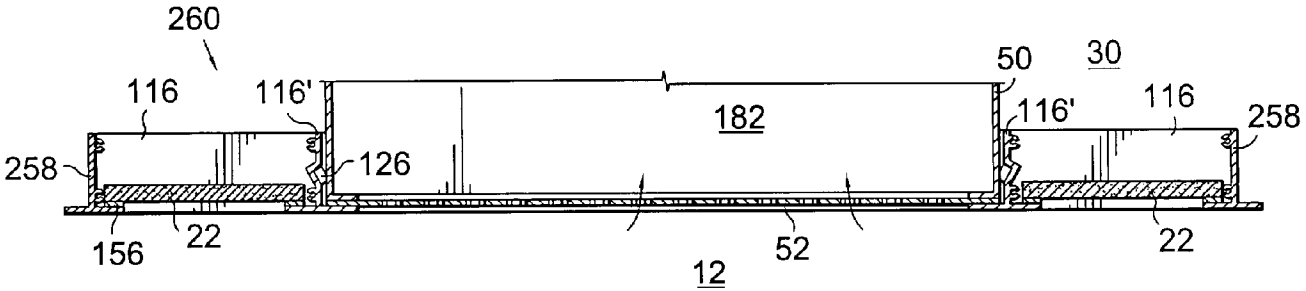
FIG. 26 is a fragmentary sectional view of the fixture modified to provide a return only without a supply.

FIG. 26 illustrates an embodiment of a return only fixture 260 for use when a user does not need to supply air from the supply plenum 30 to the room 12. In this fixture 260 the base unit 106 has had both arced sections 114 removed and replaced by sections of the modified extruded member 258. Two tiles 22 of appropriate size are placed between the modified extruded members 258 and the end sections 116' (or interior sections 112).

FIGS. 27 and 28 (diagrammatically) illustrate the modified supply/return fixture 72 used in the system illustrated in FIG. 4 and discussed above. The modified supply/return fixture 72 can be provided with a wall 262 in the conduit 50 adjacent the divider 74 to cooperate therewith to define a static space 264 therebetween. Temperature sensing components 266 can be provided therein to determine the need for the modified supply return fixture 72 to be in the heating or cooling mode by sensing the temperature of the return air as it passes through the return air conduit 76. A probe 268 can protrude from the static space 264 through the divider 74 into the return air conduit 76 to sense the temperature. The wall 262 isolates the temperature sensing components 266 from the heating coil 82. The fan 80 can be the fan unit 236 discussed above.

Figure 30:
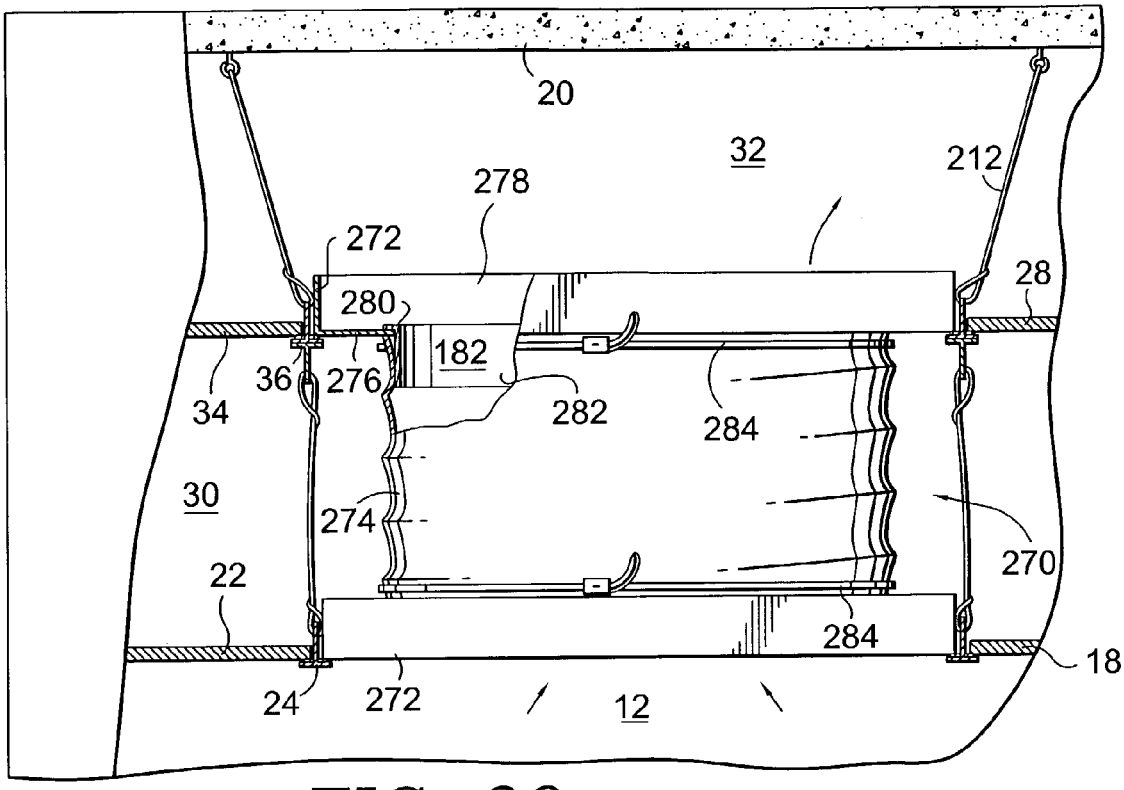
FIG. 30 is a fragmentary side elevational view of the return conduit of FIG. 29 with portions thereof cut away for clarity.

FIGS. 29 and 30 illustrate an alternate embodiment of a return only fixture 270. The fixture 270 includes upper and lower frame members 272 coupled by an expandable accordion like tubing 274. The upper and lower frame members 272 can be identical pieces. In such case a frame member 272 in the partition 28 is oriented to point downwards while the frame member 272 in the ceiling 18 is oriented in an upward direction. The frame member 272 has a horizontal base 276 with upstanding structural walls 278 around its periphery. A circular opening 280 is provided in the horizontal base and an annular flange 282 projects through the opening 280 away from the horizontal base 276 opposite the walls 278.

An inner diameter of the tubing 274 is slightly larger than an outer diameter of the protruding annular flange 282 such that the tubing 274 may be received on the annular flange 282. A strap 284 can then be cinched around the tubing 274 to couple the tubing 274 with the frame members 272. The accordion like nature of the tubing 274 provides adjustability should the distance between the ceiling 18 and the partition 28 vary.

Figure 31:
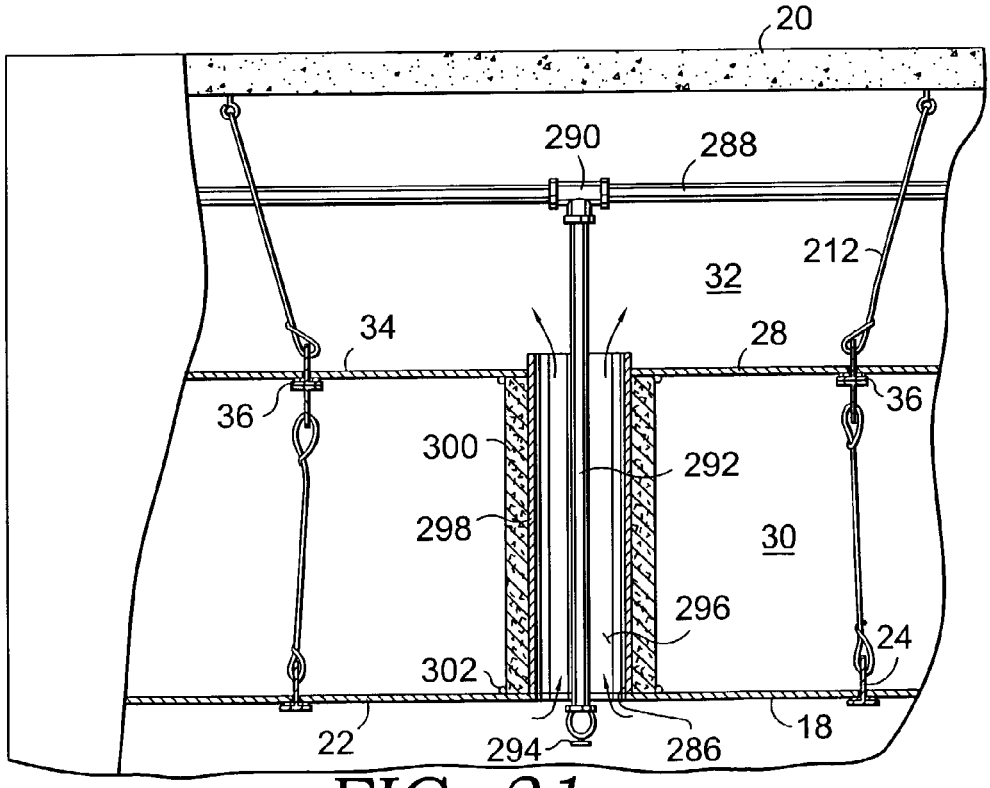
FIG. 31 is a fragmentary elevational view of another alternate embodiment of a return conduit.

FIG. 31 illustrates yet another embodiment of a return only fixture 286. In many applications involving a suspended ceiling, a need often arises to penetrate the ceiling for various mechanical components of the building, such as sprinklers. In a standard sprinkler system, as illustrated, a horizontal water pipe 288 runs below the roof 20 in the interstitial space 26. In the present embodiment, the horizontal pipe would reside in the return plenum 32. A T-fitting 290 in the pipe 288 provides for a vertical branch 292 that terminates in or slightly above the room 12 with a sprinkler head 294.

While the fixture 286 provides a return air passage 296, its primary purpose is to provide a sealed penetration through the supply plenum 30 to maintain its integrity. The fixture 286 has a wall 298. In the illustrated embodiment, the wall 298 is preferably a cylindrical tube having insulation 300 wrapped therearound. A seal 302 seals the fixture 286 to the tiles 22, 34. The seal 302 could be caulk applied where the insulation 300 meets the tiles 22, 34 after installation. A decorative flange (not shown) could be placed in the opening in the tile 22 adjacent the sprinkler head 294 for aesthetic purposes.

Figure 32:
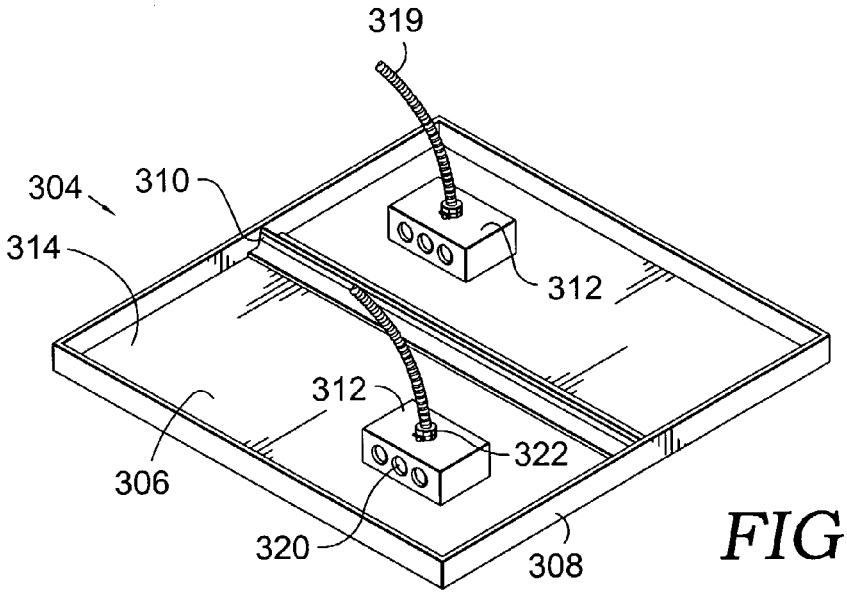
FIG. 32 is a perspective view of the electrical connections tile depicted in FIG. 33.
Figure 33:
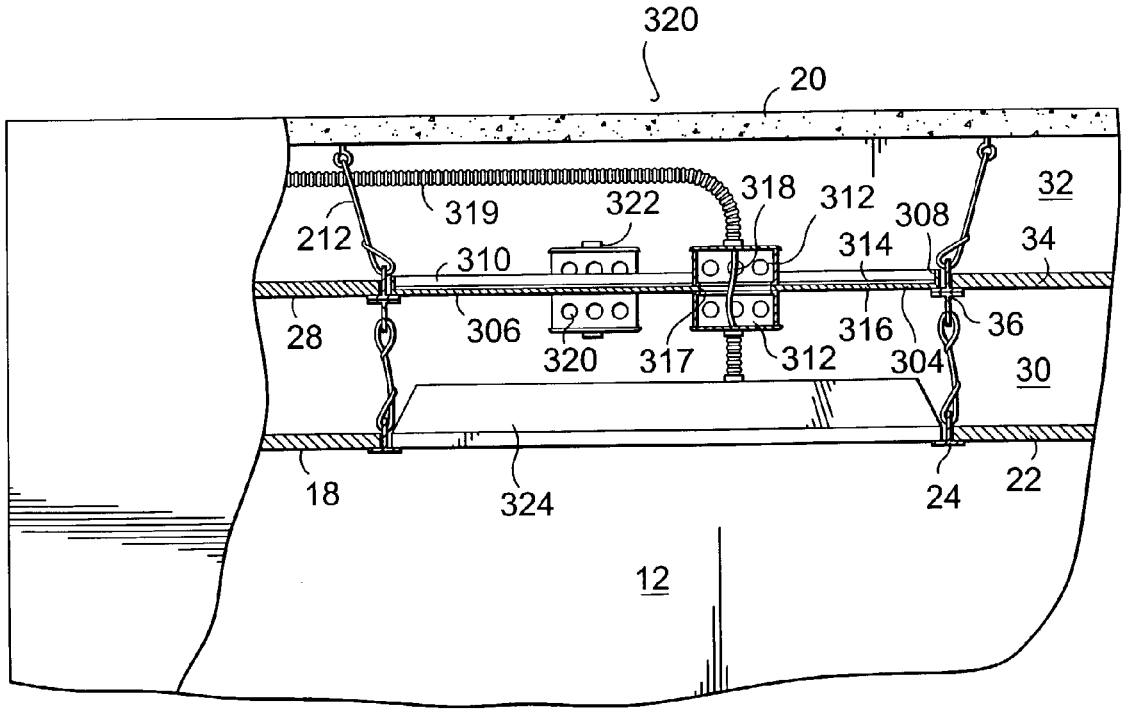
FIG. 33 is a fragmentary elevational view, partially in section, showing a light fixture mounted on the ceiling of a room equipped with an air delivery system in accordance with the present invention and also illustrating an electrical connections tile with electrical boxes that facilitate electrical connections.

FIGS. 32 and 33 illustrate a structural panel used to penetrate the partition 28 without compromising the integrity of either the supply plenum 30 or the return plenum 32. The panel 304 has a flat base portion 306 which can be a piece of sheet metal. A structural wall 308 is located around a periphery of the base portion 306 of the panel 304 and increases the rigidity of the panel 304. The panel also includes a structural rib 310 to further increase the strength and rigidity of the panel 304. A plurality of junction boxes 312 are provided on both upper and lower surfaces 314, 316 of the base portion 306.

A junction box 312 on the upper surface 314 is positioned directly above a junction box 312 on the lower surface 316. With the junction boxes still aligned, an opening 317 may be made in the base portion 306 intermediate the aligned junction boxes 312 in the space defined therebetween. The opening 317 permits a cable or electrical wire 318 to pass through the panel 304 while the two aligned junction boxes 312 cooperate to maintain the seal between the supply plenum 30 and the return plenum 32. An electrical conduit 319 can carry the wire 318 outside the junction boxes 312. As is readily apparent to one of ordinary skill in the art, the junction boxes 312 include knockouts 320 that can be used to gain access to the interior of the junction boxes 312 and connectors 322 can be used to seal where the wire 318 enters the junction box 312 through a knockout 320 and/or where the electrical conduit 319 connects to the junction box 312. The panel 304 can be positioned in the partition 28 above a light fixture 324 to permit the wire 318 from the light fixture to pass through the partition 28 without breaking the seal between the supply and return plenums 30, 32.

Figure 34:
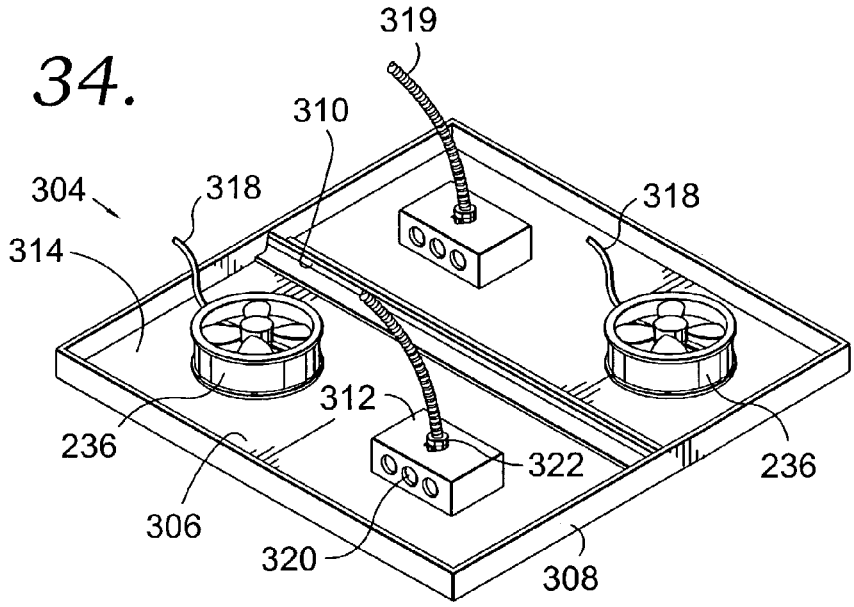
FIG. 34 is perspective view of an electrical connections panel having been modified to incorporate bypass paths.

FIG. 34 illustrates that the panel 304 can be used in connection with a plurality of fan units 236, as opposed to the hood 234, to provide an alternate embodiment of the bypass apparatus 232. The junction boxes 312 can be used in connection therewith, as illustrated, or can be left off.

To control the various systems illustrated in FIGS. 1–5, a thermostat 326, illustrated in FIG. 35 and having multiple embodiments discussed below, has been developed. The thermostat 326 of the present invention has been designed to be used with common, existing and readily available electrical accessories and devices, such as cover/face plates 328, junction boxes 330 and other similar accessories common to existing electrical devices. The constraints inherent in such a design require the thermostat 326 to sense and control temperature while it is limited to the particular packaging and mounting common to existing electrical devices, such as a light switch 332. This design resolves many aesthetic objections to thermostats and permits easy compliance with new mounting height requirements. Also, it significantly reduces the cost of production of the devices because low cost, high volume, existing accessories can be used with the thermostats.

Figure 36:
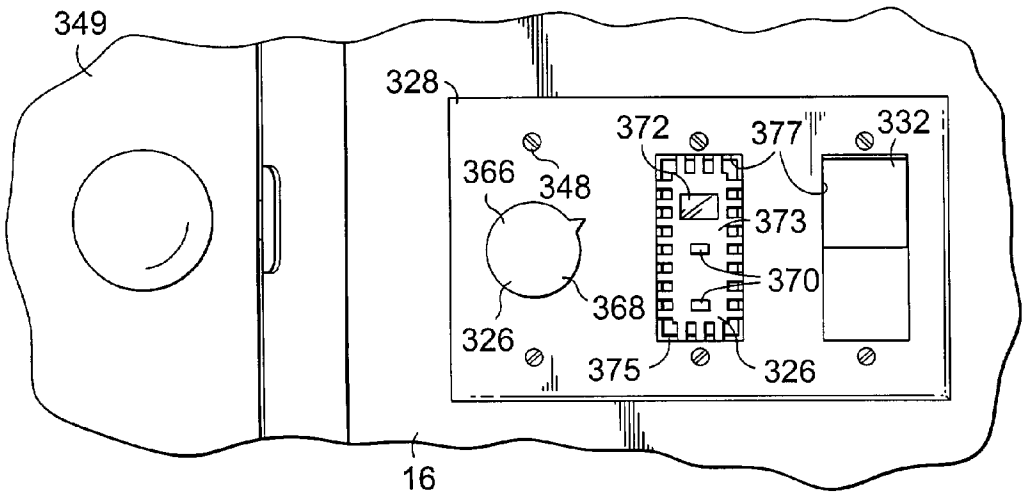
Figure 35:
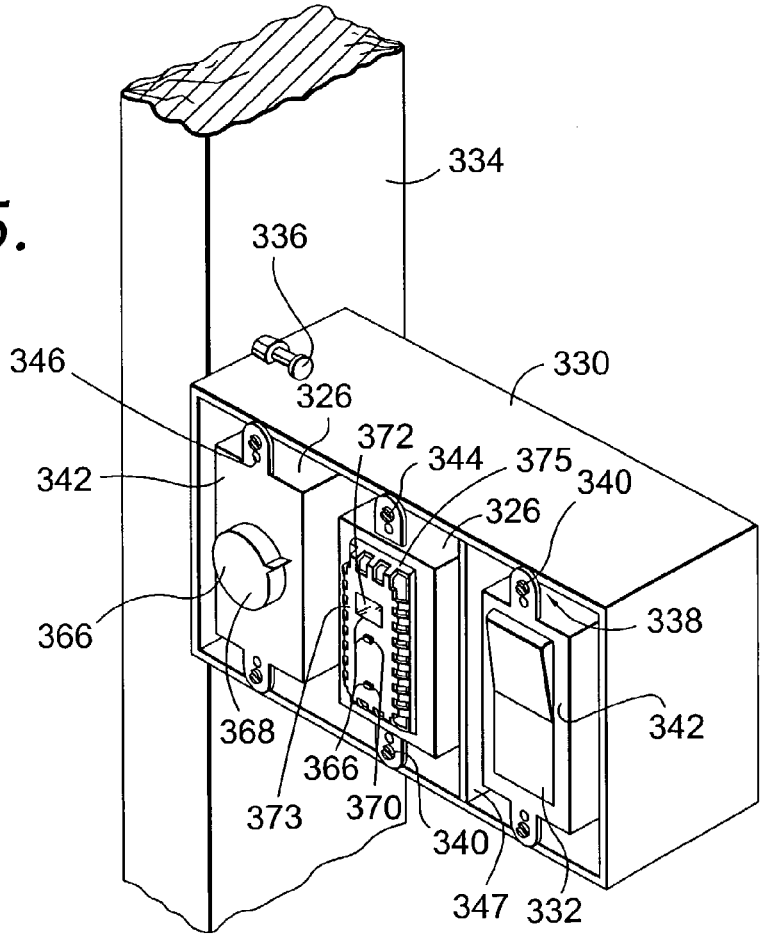
FIG. 35 is a perspective view of a wall construction without a wall covering illustrating a junction box with two thermostats of the present invention and a light switch mounted therein.

FIG. 35 illustrates two embodiments (for ease of description) of the thermostat 326 of the present invention mounted in a standard and readily available triple gang junction box 330 adjacent a light switch 332. The junction box 330 is attached to a joist 334 by a nail 336 at the appropriate height from the floor 14 (not shown), as well known in the art. The junction box 330 has a plurality of upper and lower internally threaded channels 338 (obstructed) for receiving mounting screws 340. The thermostats 326, as well as the light switch 332, have a mounting strip 342 with upper and lower mounting holes 344 (obstructed) for receiving the mounting screws 340. The mounting holes 344 are spaced apart a set distance to permit alignment with the channels 338 which are an industry standard distance apart. The mounting strips 342 also have a pair of upper and lower face plate attachment holes 346 intermediate the mounting holes 344. The distance between the face plate attachment holes 346 is also determined by an industry standard, i.e., the distance between screw holes 348 in the face plate 328. By spacing the holes 344, 346 in the mounting strip 342 industry standard distances apart, the thermostat 326 can be readily incorporated in existing devices and used with existing accessories. A barrier 347 will most likely be required in the junction box 330 by the National Electric Code. The barrier 347 is used to separate the low voltage thermostats 326 from any high voltage components, such as the light switch 332, in the junction box 330. FIG. 36 illustrates the arrangement of FIG. 35 in a finished wall 16 with the cover plate 328 in place adjacent a door 349.

Figure 37:
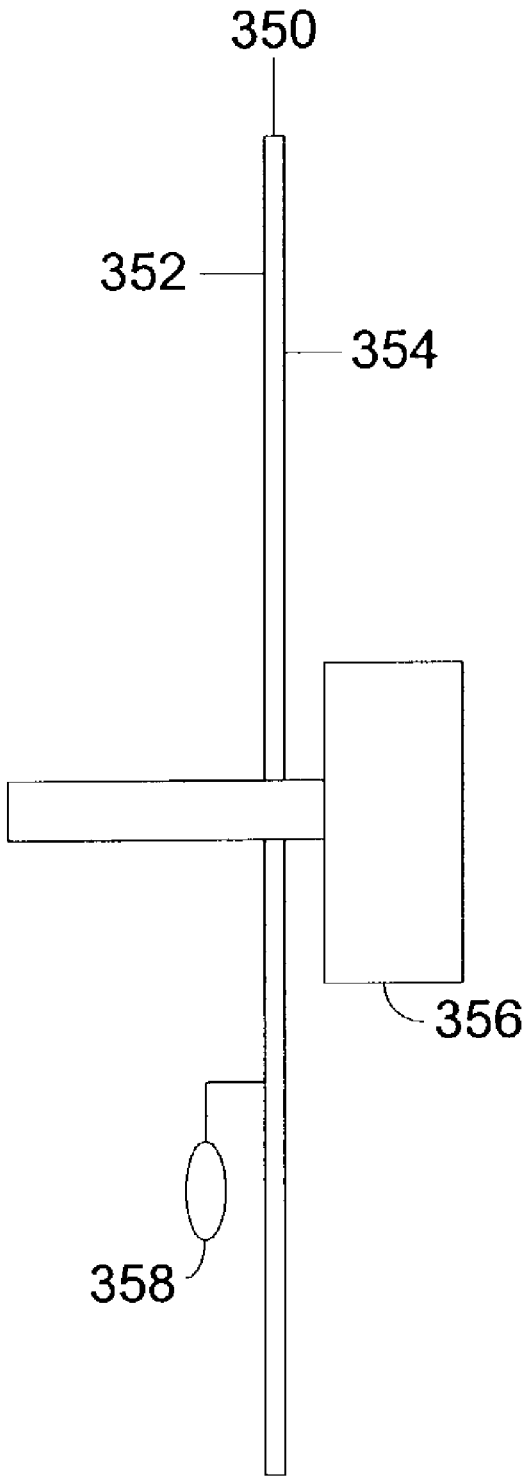
FIG. 37 is a side view of a printed circuit board of the thermostat with a variable resistor and a thermistor mounted thereto.

Turning now to FIG. 37, the sensing and control electronics of the thermostat 326 are placed on a single printed circuit board 350 that is sized to fit behind an industry standard single-gang or double/multi-gang electrical cover plate 328. The circuit board 350 has a front side 352 and a component side 354. When mounted, the front side 352 of the circuit board faces out of the junction box 330. A user setpoint adjustment control 356 is mounted to the component side 354 in a manner that allows it to be accessed through the front side 352. The user setpoint adjustment control 356 permits the user to adjust the desired temperature. In this particular embodiment, the user setpoint adjustment control 356 is a variable resistor, which is often called a potentiometer. However, it should be understood that other adjustment controls, such as digital controls that incorporate a momentary push button and a display as discussed below, are within the scope of this invention. Other components, and especially those discussed below, are mounted to the component side 354, but for clarity these components are not shown in FIG. 37.

Continuing with FIG. 37, a thermistor 358 is used to sense the ambient temperature in the area surrounding the thermostat 326. Importantly, the thermistor 358 is coupled to the front side 352 of the printed circuit board 350, which places it on the opposite side of the remaining components of the thermostat 326. In this manner, the thermistor 358 is isolated from any heat generated by those components. The placement of the thermistor 358 also allows it to be either in contact with the cover plate 328 covering the junction box 330 in which the circuit board 350 is mounted or in close proximity to the cover plate 328 when the circuit board 350 is in place. Thus, with this position, the thermistor 358 will sense and reflect the temperature of the cover plate 328, which reflects the temperature of the air surrounding the cover plate 328 and in turn the room 12, and not be affected by the temperature of the remaining thermostat components.

The various embodiments of the thermostat 326 of the present invention provide the user interfaces, signals, protocols and methodologies required to control the systems and the terminal unit 56 mentioned above. As should be understood, generally, the terminal unit 56 is controlled by two electrical signals: an on signal that causes the terminal unit 56 to open its damper blade 216; and an off signal that causes the terminal unit 56 to close its damper blade 216. For this discussion, and without limiting the invention, the on and off signals will be voltage signals, and the falling edge of the on signal will cause the terminal unit 56 to open its damper blade 216 while the falling edge of the off signal will cause the terminal unit 56 to close its damper blade 216. Many other types of electrical signals may be employed and are within the scope of this invention.

Figure 38:
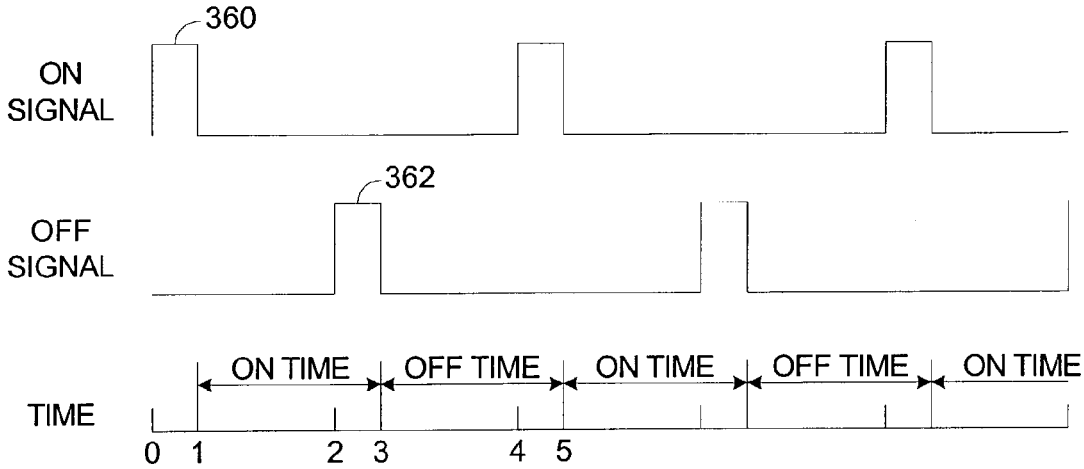
FIG. 38 shows a timing diagram of an "on" signal and an "off" signal produced by a first embodiment of the thermostat of the present invention.

In a first embodiment, the thermostat 326 controls the average amount of air delivered by the terminal unit 56 by altering the ratio of the time the damper blades 216 of the terminal units 56 are open and closed. FIG. 38 shows a typical timing diagram for this first embodiment of the thermostat 326. Specifically, signal 360 is an on signal and signal 362 is an off signal. At time 0, on signal 360 goes high while off signal 362 stays low. At time 1, on signal 360 goes low with the falling edge of on signal 360 causing the terminal unit 56 to open its damper blade 216. At time 2, off signal 362 goes high. When, at time 3, off signal 362 returns to a low value, the falling edge of this signal causes the terminal unit 56 to close its damper blade 216. The damper blades 216 will remain closed until time 5 when on signal 360 returns to a low state after going high at time 4. In this example, therefore, for the time period that extends from time 1 to time 5, the terminal unit 56 had its damper blade 216 open from time 1 to time 3 and closed from time 3 to time 5. By changing the times when on signal 360 and off signal 362 change states, the thermostat 326 controls the amount of air delivered.

Figure 39:
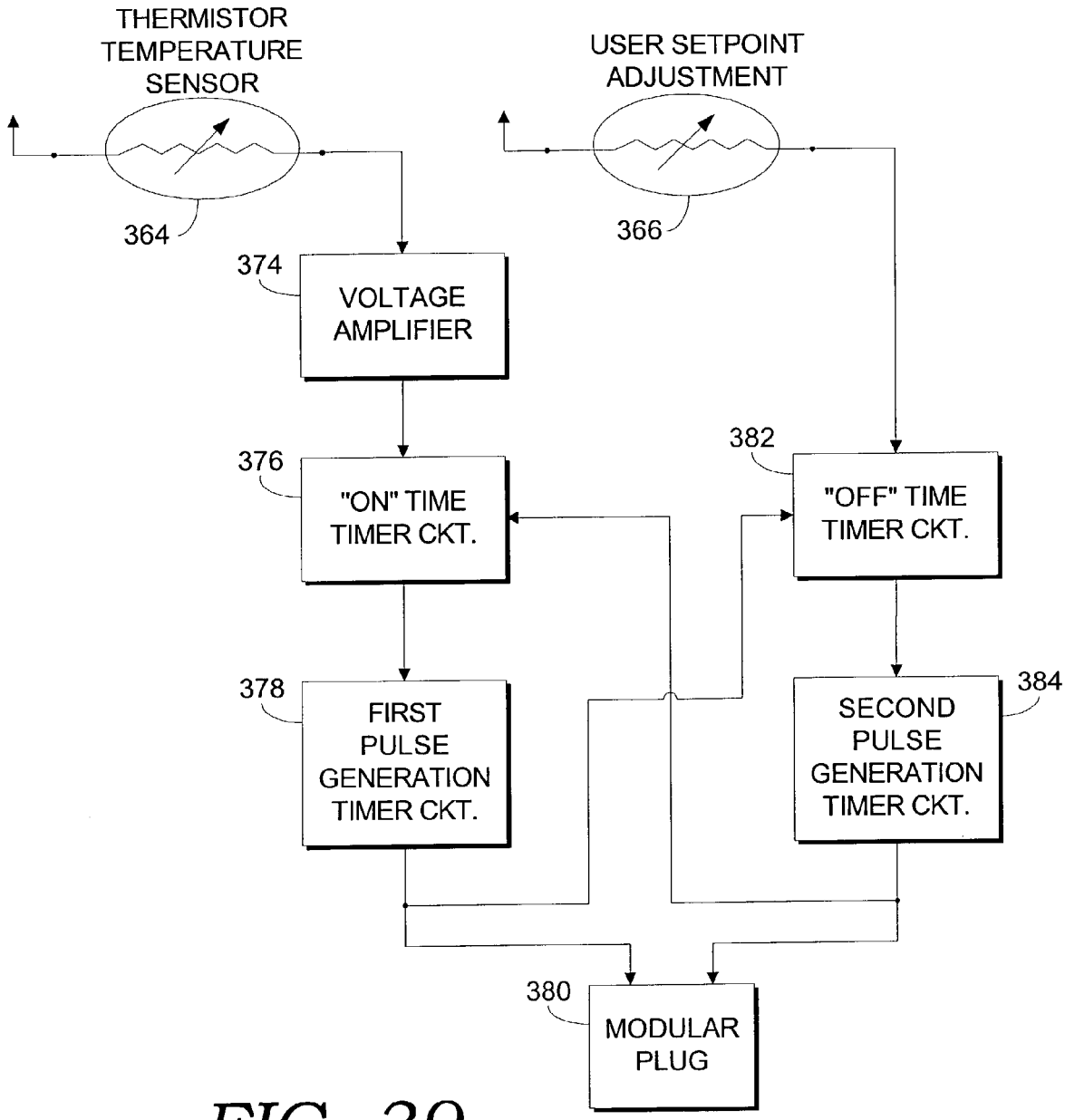
FIG. 39 shows a block diagram of the first embodiment of the thermostat that produces the signals depicted in FIG. 38.

A block diagram of one embodiment of the thermostat 326 that may be utilized to produce the signals discussed in the first embodiment of the thermostat is shown in FIG. 39. This embodiment of the thermostat 326 includes a thermistor 364 and a user setpoint adjustment 366. Both the thermistor 364 and the user setpoint adjustment 366, either alone or in combination with other commonly understood components or circuits (which are not shown), provide a variable voltage as an output.

The thermistor 364 is operable to change its resistance in response to a change in the ambient temperature. More specifically, as the temperature of the thermistor 364 rises, its resistance decreases. The user setpoint adjustment 366 is also operable to change resistance to provide a variable voltage output, except that the user setpoint adjustment 366 is manually operable. As stated above, a variable resistor is one device that may be utilized as a user setpoint adjustment 366. In FIGS. 35 and 36, the leftmost thermostat 326 incorporates a variable resistor which terminates in a user engagable knob 368. By rotating the knob 368, the user can vary the resistance and thereby vary the voltage output. Accordingly, a user can vary the desired temperature of the room 12 by rotating the knob 368. Consequently, the user can make the room 12 hotter by rotating the knob 368 one direction and colder by rotating the knob 368 the other direction.

The user setpoint adjustment 366 also may be a digital module that incorporates a display. For example, the thermostat 326 in FIGS. 35 and 36 immediately to the left of the light switch 332 has two momentary push buttons 370 that are electronically coupled to a digital circuit that includes a liquid crystal display 372. In this embodiment of the user setpoint adjustment 366, one of the push buttons 370 (preferably the upper one) would allow a user to increase the setpoint (i.e., raise the desired temperature) while the other push button 370 (preferably the lower one) would allow the user to decrease the setpoint (i.e., lower the desired temperature). The display 372 would show a number that corresponds to the setpoint. The digital circuit also would output a voltage that corresponds to the setpoint. In this embodiment of the thermostat 326, the user setpoint adjustment 366 has a face 373 that is accessible and viewable by a user in the room 12 when the cover plate 328 is attached to the junction box 330, as illustrated in FIG. 36. The face 373 has an outer periphery 375 that is sized to fit through an opening 377 in the cover plate 328. The opening 377 in the cover plate 328 is of an industry standard size. Accordingly, by dimensioning the face 373 to fit through the industry standard sized opening 377 in the cover plate 328, readily available cover plates can be used. Preferably, the face 373 is approximately 1.3 inches wide by 2.6 inches tall and is more preferably 1.310 inches wide by 2.630 inches tall.

Continuing with FIG. 39, the output of thermistor 364 is electronically coupled to the input of a voltage amplifier 374. It should be understood that the voltage amplifier 374 is operable to proportionally increase the voltage output from the thermistor 364 so that it falls within a range that is usable by the remainder of the thermostat components, and specifically by an "on" time timer circuit 376, since the output of voltage amplifier 374 is electronically coupled to this circuit. Of course, voltage amplifier 374 may not be necessary if the output voltage of thermistor 364 falls within the range of voltages acceptable as an input to the "on" time timer circuit 376. The output of the "on" time timer circuit 376 is electronically coupled to a first pulse generation timer circuit 378, and the output of the first pulse generation timer circuit 378 is electronically coupled to a modular plug 380.

On the second portion of the thermostat 326, the output of the user setpoint adjustment 366 is electronically coupled to an "off" time timer circuit 382. In a manner similar to "on" time timer circuit 376 and pulse generation timer circuit 378, the output of the "off" time timer circuit 382 is electronically coupled to a second pulse generation timer circuit 384, and the output of the second pulse generation timer circuit 384 is coupled to the modular plug 380. Finally, the output of the first pulse generation timer circuit 378 is electronically coupled to the "off" time timer circuit 382 while the output of the pulse generation timer circuit 384 is electronically coupled to the "on" time timer circuit 376.

It should be understood that the timer circuits 376, 378, 382 and 384 preferably are based on one timer from a 558 quad timer. The operation of 558 timers is well known, as are the circuits used and the components necessary to generate a pulse with a variable length.

In operation, when power is applied to the thermostat 326, the output of the second pulse generation timer circuit 384 goes high for a predetermined length of time. This signal (on signal 360 in FIG. 38) triggers the "on" signal timer circuit 376 which signals the terminal unit 56 to open the damper blade 216. Thereafter, the "on" signal timer circuit 376 produces an output signal with a length that is controlled by the output from the thermistor 364, after being amplified by the voltage amplifier 374. In FIG. 38, the length of this signal is from time 1 to time 2. This output is used to trigger the first pulse generation timer circuit 378, which produces an output high signal of predetermined length (off signal 362 in FIG. 38) that signals to the terminal unit 56 to close the damper blade 216. The output of the first pulse generation timer circuit 378 also triggers the "off" time timer circuit 382, which produces a high signal with a length controlled by the output from the user setpoint adjustment 366. In FIG. 38, the length of this signal is from time 3 to time 4.

The output of the "off" time timer circuit 382 triggers the second pulse generation timer circuit 384 to produce a high signal of predetermined length (on signal 360 in FIG. 38) that signals to the terminal unit 56 to open the damper blade 216. Thus, the timer circuits are interconnected so that the completion of the "on" time timer signal triggers the signal that closes the damper blade 216 and the completion of the "off" time timer signal triggers the signal that opens the damper blade. Similarly, the completion of the "on" time output signal triggers the "on" time timer signal while the completion of the "off" time output signals triggers the "off" time timer signal. This interconnection causes the "on" and "off" pulses to repeat indefinitely.

It should be understood that the specific embodiment discussed with regard to FIG. 39 is one of several possible analog configurations. The timing and control signals could also be provided by a microprocessor or microcontroller that is programmed to provide the same functions.

Figure 40:
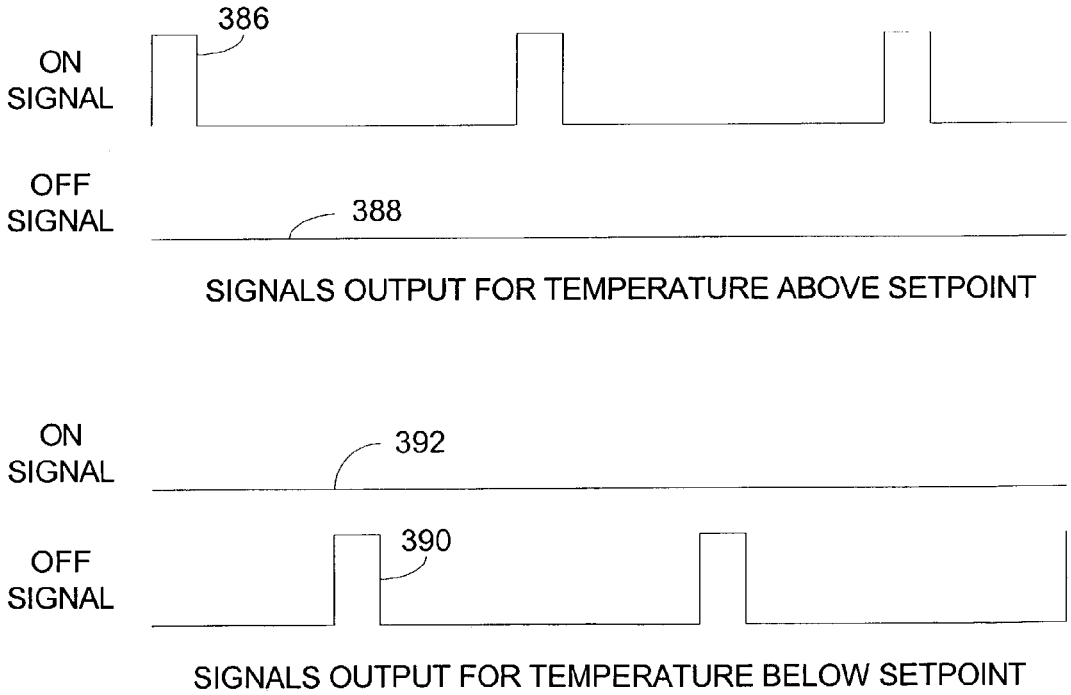
FIG. 40 shows a timing diagram of an "on" signal and an "off" signal produced by a second embodiment of the thermostat of the present invention.

In a second embodiment, the thermostat 326 produces the signals shown in FIG. 40. This embodiment illustrates a traditional "on-off" method in which for cooling mode the terminal unit 56 is open so long as the temperature is above the user setpoint and closed whenever the temperature is at of below the user setpoint. For heating mode, the conditions are reversed. In FIG. 40, the output signal for cooling mode are presented. When the temperature is above the setpoint, an on signal 386, which is a pulse that is generated periodically, opens the damper blade 216 of the terminal unit 56 and an off signal 388 remains low. When the temperature is below the setpoint, an off signal 390, which also is a pulse that is generated periodically, closes the damper blade 216 of the terminal unit 56 and an on signal 392 remains low.

Figure 41:
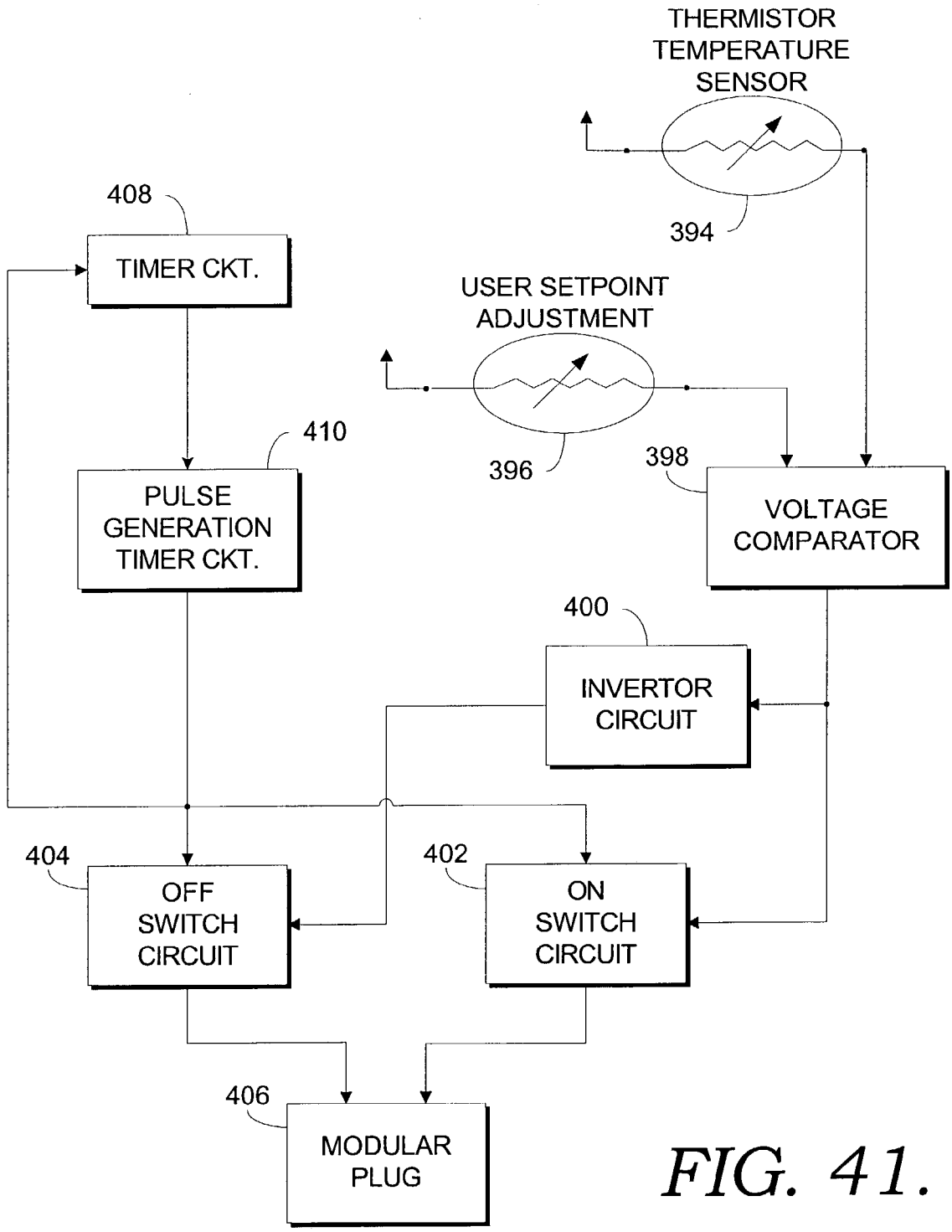
FIG. 41 shows a block diagram of the second embodiment of the thermostat that produces the signals depicted in FIG. 40.

A block diagram of one embodiment of a thermostat 326 that may be utilized to produce the signals discussed in the second embodiment of the thermostat is shown in FIG. 41. This embodiment of the thermostat 326 includes a thermistor temperature sensor 394 and a user setpoint adjustment 396. The outputs of these two devices are electronically coupled to a voltage comparator 398. As is known, a voltage comparator is a device that is operable to compare the voltage levels of two inputs and provide an output that is indicative of which input is higher. The voltage comparator 398 is configured so that the output is high if the thermistor output voltage is higher than the user setpoint adjustment output voltage and low if the opposite is true.

Continuing with FIG. 41, the output of the voltage comparator 398 is electronically coupled to an invertor circuit 400 and on switch circuit 402. The invertor circuit 400 is operable to provide an output that is the inverse of the input. Thus, if the input to the invertor circuit 400 is high, then the output of invertor circuit 400 is low. The output of the invertor circuit 400 is electronically coupled to an off switch circuit 404. Switch circuits 402 and 404 are operable to allow the signal to pass through a signal input if the control level is high and block the signal input if the control level is low. As shown in FIG. 41, if the output of the voltage comparator 398 is high then the on switch circuit 402 passes its signal input though while the off switch circuit 404 blocks its signal input. If the output of the voltage comparator 398 is low then the off switch circuit 404 passes its signal input though while the on switch circuit 402 blocks its signal input. The output of both the on switch circuit 402 and the off switch circuit 404 are electronically coupled to a modular plug 406.

Also present in FIG. 41 are a timer circuit 408 and a pulse generation circuit 410. These two circuits are operable to produce the on and off signals shown in FIG. 40. Preferably, these circuits 408 and 410 are based on one timer from a 558 quad timer. Thus, the output of the timer circuit 408 is electronically coupled to the trigger of the pulse generation circuit 410. The output of the pulse generation circuit 410 is tied to the signal inputs of the on switch circuit 402, the off switch circuit 404 and to the trigger of the timer switch circuit 408.

In operation, as indicated above, if the thermistor output voltage is higher than the user setpoint adjustment output voltage, which would indicate that the space needs cooling, then the output of the voltage comparator 398 is high. This high output causes the on switch circuit 402 to pass its signal input and the off switch circuit 404 to block its input. In this manner, the terminal unit 56 receives a signal that causes it to open its damper blade 216. Similarly, if the user setpoint adjustment output voltage is higher than the thermistor output voltage, which would indicate that the space needs heating, then the output of the voltage comparator 398 is low. This low output causes the off switch circuit 404 to pass its signal input and the on switch circuit 402 to block its input. In this manner, the terminal unit 56 receives a signal that causes it to close its damper blade 216.

The first and second embodiments of the thermostat 326 discussed above are zone thermostats. There are applications, however, that require a thermostat to control a roof top unit or an air-handling unit. The control functions of this type of thermostat must comply with established control conventions for the equipment controlled. A third embodiment of the thermostat 326 complies with these conventions.

Figure 42:
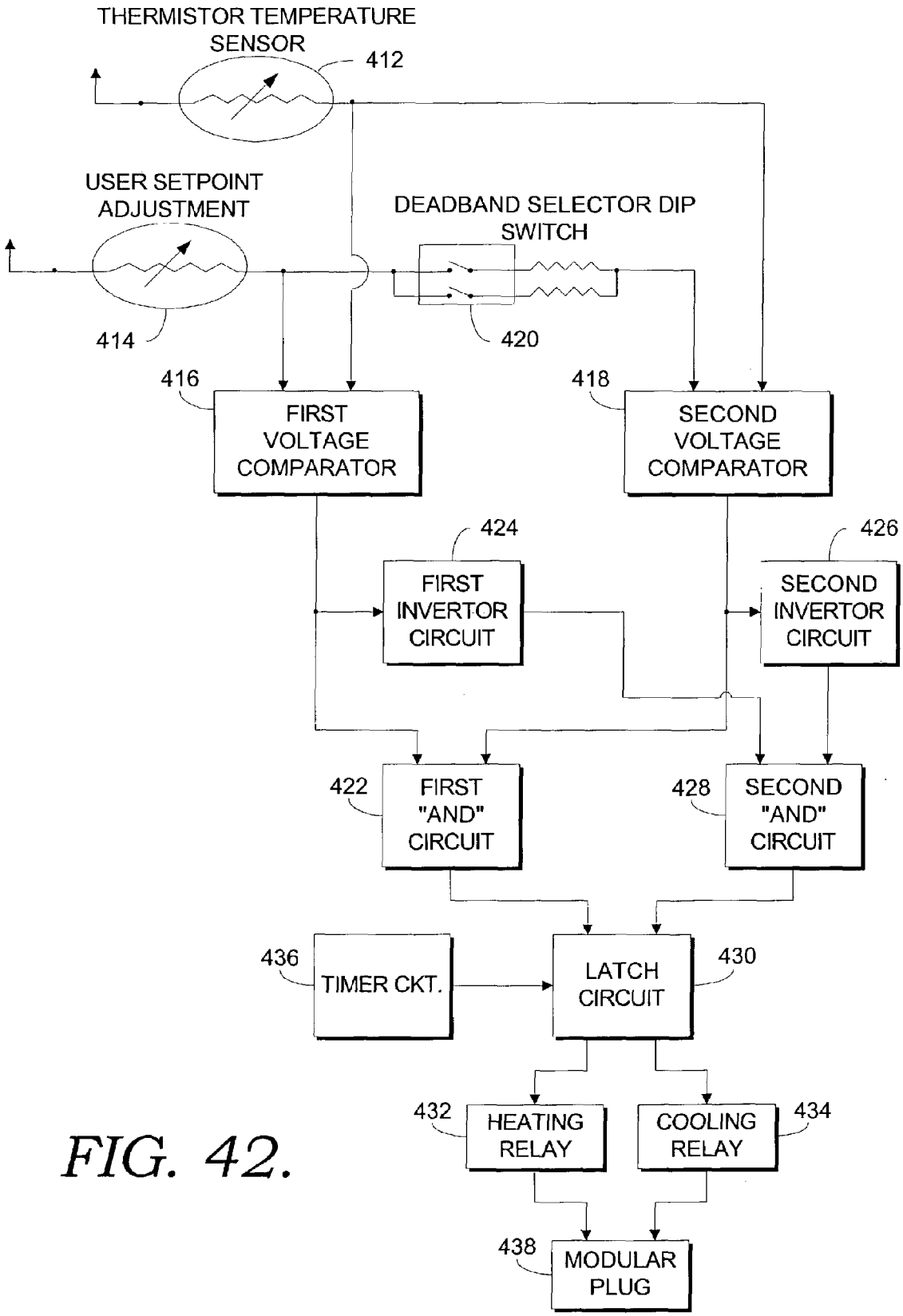
FIG. 42 shows a block diagram of a third embodiment of the thermostat of the present invention.

In FIG. 42, a block diagram of the third embodiment of the thermostat 326 is shown. This embodiment of the thermostat 326 retains the physical shape and dimensions of the first and second embodiments so that it too fits within the packaging common to existing electrical devices. This embodiment of the thermostat 326 includes a thermistor temperature sensor 412 and a user setpoint adjustment 414. It should be understood that any of the user setpoint adjustments described herein could take the form of any of the embodiments therefor known or described herein (e.g. the variable resistor or the momentary push buttons). The output of thermistor 412 is electronically coupled to a first voltage comparator 416 and a second voltage comparator 418. The output of the user setpoint adjustment 414 is electronically coupled to first voltage comparator 416 and to a deadband selector dip switch 420.

Continuing with FIG. 42, the outputs of the voltage comparators 416 and 418 are electronically coupled to a first "and" circuit 422. In addition, the output of first voltage comparator 416 is electronically coupled to a first invertor circuit 424 while the output of second voltage comparator 418 is electronically coupled to a second invertor circuit 426. The outputs of both invertor circuits 424 and 426 are electronically coupled to a second "and" circuit 428. It should be understood that an "and" circuit is operable to compare two inputs and provide a high output if the two inputs are high. If either input is low, then the output of an "and" circuit is low.

Continuing with FIG. 42, the outputs of both "and" circuits 422 and 428 are electronically coupled to a latch circuit 430. The latch circuit 430 has two outputs, one that is electronically coupled to a heating relay 432 and one that is electronically coupled to a cooling relay 434. Also, the output of a timer circuit 436 is electronically coupled to the latch circuit 430. Finally, both the output of heating relay 432 and the output of cooling relay 434 are electronically coupled to a modular plug 438.

In operation, the voltage output of the user setpoint adjustment 414 and the output of the thermistor 412 are compared by both the first voltage comparator 416 and the second voltage comparator 418. Two comparators are used with a preset and fixed voltage difference between them because the system must have a deadband between heating and cooling functions. The deadband selector dip switch 420 allows selection of the value of this resistance which ultimately is equal to the temperature difference or deadband selected by the two comparators 416, 418. For cooling to occur both the first voltage comparator 416 and the second voltage comparator 418 must sense that the output of the thermistor 412 is above the output of the user setpoint adjustment 414 and for heating to occur both the first voltage comparator 416 and the second voltage comparator 418 must sense that the output of the thermistor 412 is below the output of the user setpoint adjustment 414. To prevent short cycling, the temperature result is sampled by means of the timer circuit 436 and the latch circuit 430. Preferably, the output of the comparators 416 and 418 are latched approximately once every five minutes. The timer circuit 436 and the latch circuit 430 prevent a change in the state of the output of the relays 432 and 434 from occurring for a time interval less than five minutes.

Not shown is a switch for the unit fan (such as blower 40) that can be built into the user setpoint adjustment 414 so that the fan is turned on whenever the switch is positioned to a particular setting. The deadband settings selected by the deadband selector dip switch 420 generally are two degrees and five degrees to comply with user requirements and ASHRAE requirements. The output of relays 432 and 434 can be rated for 24 VAC, 1 ampere duty common to most HVAC applications.

While all of the embodiments of the thermostat 326 have been designed and described as being for installation and use in a wall 16, it would be readily understood by one of ordinary skill in the art and is within the scope of the present invention that the components of the various embodiments of the thermostat 326 could be used to control the various systems while contained in a stand alone device mounted separately on the wall 16 in the manner typical of the prior art.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A method for delivering conditioned air to a room having a space located above a ceiling overlying the room, said method comprising:

separating said space into a supply plenum and a return plenum, said supply and return plenums together occupying a substantial portion of the volume of said space and being located generally one above the other;

delivering conditioned air to said supply plenum;

discharging the conditioned air from said supply plenum into the room;

directing return air from the room into said return plenum; and discharging the return air from said return plenum;

wherein said supply plenum is above and adjacent to said ceiling and said return plenum is above and adjacent to said supply plenum, and wherein said step of separating said space into a supply plenum and a return plenum comprises suspending a substantially horizontal partition in said space at a location above and generally parallel to said ceiling.

2. A method as set in claim 1, wherein said step of delivering conditioned air to said supply plenum comprises delivering conditioned air thereto at a pressure less than about 0.1 inches wg above a pressure of the room.

3. A method as set in claim 2, wherein said step of delivering conditioned air to said supply plenum comprises delivering conditioned air thereto at a pressure of approximately 0.05 inches wg above the pressure of the room.

4. A method as set in claim 3, including the step of maintaining said return plenum at a pressure of approximately 0.02 inches wg below the pressure of the room.

5. A method as set in claim 1, wherein:

said step of discharging the conditioned air from said supply plenum into the room comprises discharging the air into the room at a selected location on the ceiling; and said step of directing return air from the room into said return plenum comprises directing the return air out of the room through the ceiling at a location adjacent to said selected location.

6. A method as set in claim 1, wherein said step of discharging the conditioned air from said supply plenum into the room comprises:

sensing a temperature condition in the room; and varying the volume rate of flow from the supply plenum into the room in a manner that depends on said temperature condition.

7. A method as set in claim 1, wherein said step of discharging the conditioned air from said supply plenum into the room is carried out at a substantially constant volume rate of air flow.

8. A method as set in claim 1, including the steps of providing a bypass path from said return plenum to said supply plenums; and forcing a selected amount of air from the return plenum into the supply plenum through said bypass path.

9. A method as set in claim 1, wherein said supply plenum and said return plenum are normally maintained at a pressure of approximately zero and said step of discharging conditioned air from said supply plenum into the room comprises arranging an intake side of a fan in communication with said supply plenum and selectively activating said fan to direct air from said supply plenum into the room.

10. A method as set forth in claim 9, including the step of heating the air at a location downstream from said fan before the air enters the room.

11. A method for delivering conditioned air to a room having a space located above a ceiling overlying the room, said method comprising:

separating said space into a supply plenum and a return plenum, said supply and return plenums together occupying a substantial portion of the volume of said space and being located generally one above the other;

delivering conditioned air to said supply plenum;

discharging the conditioned air from said supply plenum into the room;

directing return air from the room into said return plenum;

discharging the return air from said return plenum;

providing a bypass path from said return plenum to said supply plenum;

closing said bypass path when conditioned air is being discharged from said supply plenum into the room;

stopping the discharge of conditioned air from the supply plenum into the room at selected times;

opening said bypass path at selected times when the discharge of conditioned air from the supply plenum into the room is stopped; and forcing air through said bypass path from the return plenum into the room when said bypass path is open.

12. A method as set in claim 11, including the step of heating the air flowing through said bypass path.

13. Apparatus for delivering conditioned air to a room having a ceiling and a space above the ceiling, said apparatus comprising:

a supply plenum in said space;

a return plenum in said space, said supply plenum and said return plenum together occupying a substantial portion of said space;

a source of conditioned air connected with said supply plenum to deliver conditioner air thereto;

an air register in the ceiling arranged to direct conditioned air into the room from said supply plenum;

a return air path extending from the room to said return plenum to direct return air to said return plenum;

said supply plenum immediately overlies said ceiling; and said return plenum immediately overlies said supply plenum and is separated therefrom by a substantially horizontal partition.

14. Apparatus as set in claim 13, wherein said return air path includes:

a return register in the ceiling; and a generally vertical conduit extending from said return register to said return plenum, said conduit extending through and being sealed from said supply plenum.

15. Apparatus as set in claim 14, wherein said air register and said return register are adjacent to one another.

16. Apparatus as set in claim 15, wherein said air register is arranged to direct air generally away from said return register.

17. Apparatus as set in claim 13, including a control for said air register arranged to control the volume rate of air flow through said air register into the room.

18. Apparatus for delivering conditioned air to a room having a ceiling and a space above the ceiling, said apparatus comprising:

a supply plenum in said space;

a return plenum in said space, said supply plenum and said return plenum together occupying a substantial portion of said space;

a source of conditioned air connected with said supply plenum to deliver conditioner air thereto;

an air register in the ceiling arranged to direct conditioned air into the room from said supply plenum;

a return air path extending from the room to said return plenum to direct return air to said return plenum;

a bypass path from said return plenum to said supply plenum; and a fan having an active condition wherein air is forced by said fan through said bypass path from said return plenum to said supply plenum.

19. A method for delivering conditioned air to a room having a space located above a ceiling overlying the room, the method comprising:

separating the space into a supply plenum and a return plenum, wherein separating the space includes suspending a substantially horizontal partition in the space at a location above and generally parallel to the ceiling, and wherein the supply and return plenums together occupy a substantial portion of the volume of the space and are located generally one above the other;

delivering conditioned air to the supply plenum;

discharging the conditioned air from the supply plenum into the room;

directing return air from the room into the return plenum; and discharging the return air from the return plenum.

20. The method of claim 19, wherein the supply plenum is above and adjacent to the ceiling and the return plenum is above and adjacent to the supply plenum.

21. The method of claim 20, wherein the supply plenum abuts the ceiling and wherein the return plenum abuts the partition.

22. The method of claim 21, wherein the supply plenum further abuts the partition.

23. The method of claim 19, wherein one of the plenums is at least partially bounded by the ceiling.

24. The method of claim 19, wherein one of the plenums is at least partially bounded by the partition.

25. The method of claim 19, wherein one of the plenums is at least partially bounded by both the ceiling and the partition and wherein the other plenum is at least partially bounded by the partition.

26. The method of claim 19, wherein the conditioned air is delivered to the supply plenum at a pressure less than about 0.1 inches wg above a pressure of the room.

27. The method of claim 19, further comprising:

providing a bypass path from the return plenum to the supply plenum; and forcing a selected amount of air from the return plenum into the supply plenum through the bypass path.

* * * * *